US005355915A

United States Patent [19]

Payne

[11] Patent Number: 5,355,915

[45] Date of Patent: Oct. 18, 1994

[54] VAPOR RECOVERY IMPROVEMENTS

[75] Inventor: Edward A. Payne, Greensboro, N.C.

[73] Assignee: Gilbarco, Greensboro, N.C.

[21] Appl. No.: 946,741

[22] Filed: Sep. 16, 1992

Related U.S. Application Data

[63] Continuation-in-part of Ser. No. 824,702, Jan. 21, 1992, Pat. No. 5,156,199, which is a continuation of Ser. No. 625,892, Dec. 11, 1990, abandoned.

[51] Int. Cl.[5] ..... B65B 3/18

[52] U.S. Cl. ..... 141/83; 141/59; 141/198; 141/44

[58] Field of Search ..... 141/1, 4, 5, 44–46, 141/51, 59, 83, 192, 198, 128; 137/587–589; 55/587

[56] References Cited

U.S. PATENT DOCUMENTS

| | | | |
|---|---|---|---|
| 3,899,009 | 8/1975 | Taylor | 141/59 |
| 4,068,687 | 1/1978 | Long | 141/59 |
| 4,072,934 | 2/1978 | Hiller et al. | 340/243 |
| 4,199,012 | 4/1980 | Lasater | 141/52 |
| 4,253,503 | 3/1981 | Gunn | 141/59 |
| 4,306,594 | 12/1981 | Planck | 141/59 |
| 4,429,725 | 2/1984 | Walker et al. | 141/59 |
| 5,038,838 | 8/1991 | Bergamini | 141/59 |
| 5,040,577 | 8/1991 | Pope | 141/59 |
| 5,156,199 | 10/1992 | Hartsell, Jr. et al. | 141/83 |
| 5,195,564 | 3/1993 | Spalding | 141/1 |
| 5,197,523 | 3/1993 | Fink, Jr. et al. | 141/206 |
| 5,280,814 | 1/1994 | Stroh | 141/83 |

FOREIGN PATENT DOCUMENTS

| | | |
|---|---|---|
| 0443068A1 | 2/1990 | European Pat. Off. . |
| 3903603A1 | 8/1990 | Fed. Rep. of Germany . |
| 2206561 | 1/1989 | United Kingdom . |

*Primary Examiner*—Ernest G. Cusick

*Attorney, Agent, or Firm*—Rhodes, Coats & Bennett

[57] ABSTRACT

A vapor recovery fuel dispenser includes a liquid fuel pump for pumping and blending liquid fuels from fuel reservoirs along a fuel delivery line to an outlet. A vapor pump returns fuel vapors from proximate the outlet along a vapor return line to a repository. An electric motor drives the pump in response to a signal. An electrically-activatable valve is provided in the vapor return line. A first sensor generates a first pulse train representative of the flow rate of the liquid fuel pump and a second sensor generates a second pulse train representative of the flow rate of the vapor pump.

A controller is operably interposed between the liquid fuel pumps and the vapor pump. The controller monitors whether the liquid pumps are operating, whether the vapor pump motor is operating, and the electrical current to the vapor pump motor. It also outputs an electrical signal to open the valve when the motor or liquid fuel pump is operating and to close the valve when motor operation or liquid pumping is not detected. Further, it controls the speed of the vapor pump to return substantially all fuel vapors proximate the outlet with substantially no air in response to evaluations of the pulse trains. The controller also disables operation of the vapor pump when the liquid pumps are not operating, vapor pump motor operation is detected while not signaled to operate, or the monitored current indicates a system error.

76 Claims, 6 Drawing Sheets

VAPOR RECOVERY IMPROVEMENTS

This application is a continuation in part of U.S. Pat. No. 07/824,702 filed Jan. 21, 1992 (now U.S. Pat. No. 5,156,199, issued Oct. 20, 1992) which is a continuation of U.S. Patent application Ser. No. 07/625,892 filed Dec. 11, 1990 (now abandoned).

BACKGROUND OF THE INVENTION

The present invention relates to improvements in vapor recovery fuel dispensers, particularly those with positively driven vapor pumps.

Vapor recovery fuel dispensers, particularly gasoline dispensers, have been known for quite some time, and have been mandatory in California since the early 1980's. The primary purpose of using a vapor recovery fuel dispenser is to retrieve or recover the vapors which would otherwise by emitted to the atmosphere during a fueling operation, particularly for motor vehicles. The vapors of concern are generally those which fill the vehicle gas tank. As the liquid gasoline is pumped into the tank, the vapor is displaced and forced out through the filler pipe.

The traditional vapor recovery apparatus is known as the "balance" system, in which a sheath or boot encircles the liquid fueling nozzle and connects with tubing back to the fuel reservoir. As the liquid enters the tank, the vapor is forced into the sheath and back toward the fuel reservoir where the vapors can be stored or recondensed.

Balance systems have numerous drawbacks, including cumbersomeness, difficulty of use, ineffectiveness when seals are poorly made, and slowed fueling rates.

As a dramatic step to improve on the balance systems, Glibarco, Inc., assignee of the present invention, patented an improved vapor recovery system for fuel dispensers, U.S. Pat. No. 5,040,577 to Kenneth L. Pope. The Pope patent discloses a vapor recovery apparatus in which a vapor pump is introduced in the vapor return line, driven by a motor. The liquid pump includes a pulser, conventionally used for generating pulses indicative of the amount of liquid fuel being pumped. A microprocessor translates the pulses indicative of the liquid flow rate into a desired vapor pump operating rate. The effect was to permit the vapor to be pumped at a rate correlated with the liquid flow rate so that, as liquid is pumped faster, vapor is also pumped faster, and vice versa.

While the apparatus described in the Pope patent is significant and quite workable, various improvements and refinements have been discovered to further enhance the usability of it and similar vapor recovery systems.

In particular, since the vapor pump is independently driven, in the event of a malfunction so that the vapor pump is operating when the liquid pump is not, there is a possibility of drawing large volumes of air into the liquid storage tank. When the quantity of air reaches a high enough level, the air/vapor mixture in the tank can reach dangerously explosive proportions. Accordingly, safety features are needed to assure that excessive amounts of air are not drawn in.

In addition, some liquid fuel dispensers have multiple pumps, drawing from different fuel reservoirs, so different grades of fuel can be combined to make a blended product. The Pope patent does not address how to control the vapor pump in such a circumstance.

Further, it has been found that if liquid is pumped back through the vapor pump line, damage to the vapor pump can result, so that a need is present to deal with that circumstance.

Also, a need still existing is to prevent the escape of the vapor from the vapor pump recovery system during periods of idleness. Accordingly, these and other needs still remain unfulfilled.

SUMMARY OF THE INVENTION

The present invention fulfills these needs in the art by providing a vapor recovery fuel dispenser. One embodiment includes a liquid fuel pump for pumping liquid fuel from a fuel reservoir along a fuel delivery line to an outlet, a vapor pump for returning fuel vapors from proximate the outlet along a vapor return line to a vapor repository, and a controller operably interposed between the liquid fuel pump and the vapor pump which monitors when both pumps are operating and disables operation of the vapor pump when the liquid pump is not operating.

In a preferred embodiment the controller permits continued operation of the vapor pump for a short period after liquid pumping cessation is detected to allow for mechanical inertia. In some embodiments the controller monitors a plurality of liquid pumps and permits continued operation of the vapor pump as long as one of the liquid pumps is operating. For example, the controller may combine signals from the liquid pumps in exclusive OR gates to derive a single signal indicative of operation of any of the liquid pumps.

Also in a preferred embodiment the vapor pump includes a motor having a tachometer and the controller detects operation of the vapor pump from a signal from the tachometer.

Preferably, the motor is a three phase brushless DC motor and each phase has a tachometer in the form of a hall effect sensor monitored by the controller. The controller combines signals from the hall effect sensors in exclusive OR gates to derive a single signal indicative of operation of the vapor pump. The controller may combine signals from a plurality of liquid pumps in exclusive OR gates to derive a single signal indicative of operation of any of the pumps and compare the single signal indicative of operation of the vapor pump and the single signal indicative of operation of the liquid pumps. Preferably, the controller disables operation of the fuel dispenser if the two signals disagree for a period of time in excess of a threshold.

In another aspect the invention provides a vapor recovery fuel dispenser including a vapor pump for returning fuel vapors from proximate a liquid fuel outlet along a vapor return line to a vapor repository, a motor driving the pump in response to a signal to operate the vapor pump, and a controller which monitors when the motor is operating and disables operation of the vapor pump motor when motor operation is detected while not signaled to operate. Typically, the controller permits continued operation of the vapor pump motor for a short period after detection of cessation of the signal to operate to allow for mechanical inertia. Preferably, the motor has a tachometer and the controller detects operation of the motor from a signal from the tachometer. In a preferred embodiment the motor is a three phase brushless DC motor and each phase has a tachometer in the form of a hall effect sensor monitored by the controller. The controller combines signals from the hall effect sensors in exclusive OR gates to derive a single signal indicative of operation of the motor. Preferably, the controller disables operation of the motor if the signal indicative of operation of the motor and the signal to operate the vapor pump disagree for a period of time in excess of a threshold.

In a preferred embodiment the signal indicative of operation of the motor is a pulse train and the controller counts pulses in the pulse train during periods when the signal to operate the vapor pump is absent and disables operation of the motor when a threshold number of pulses is counted.

In a further aspect, the invention provides a vapor recovery fuel dispenser including a vapor pump for returning fuel vapors from proximate a liquid fuel outlet along a vapor return line to a vapor repository, an electric motor driving the pump, and a controller which monitors the electrical current to the motor and disables operation of the vapor pump motor when the monitored current indicates a system error, such as liquid fuel blocking the vapor return line. Preferably, the controller permits continued operation of the vapor pump motor during short periods of high current but disables operation when current exceeds a threshold level for a threshold period of time. In one embodiment the motor current is detected by a drop in voltage across a resistive element in series with a motor winding. Typically the motor is a three phase brushless DC motor. Desirably, the controller includes a filter to filter the voltage across the resistive element to remove noise. In a preferred embodiment the controller includes a potentiometer between a voltage source and a comparator, and the filtered voltage is applied to the comparator. The controller disables operation of the motor if the filtered voltage exceeds a voltage set by a setting of the potentiometer for a period of time in excess of a threshold period of time.

In a further aspect, the invention provides a vapor recovery fuel dispenser including a vapor pump for returning fuel vapors from proximate a liquid fuel outlet along a vapor return line to a vapor repository, an electrically-activatable valve in the vapor return line, a motor driving the pump in response to a signal to operate the vapor pump, and a controller which monitors when the motor is operating and outputs an electrical signal to open the valve when the motor is operating and to close the valve when motor operation is not detected.

In one embodiment the motor has a tachometer and the controller detects operation of the motor from a signal from the tachometer. Preferably, the motor is a three phase brushless DC motor and each phase has tachometer in the form of a hall effect sensor monitored by the controller. Typically, the controller combines signals from the hall effect sensors in exclusive OR gates to derive a single signal indicative of operation of the motor. In a preferred embodiment the signal indicative of operation of the motor is a pulse train and the controller converts pulses in the pulse train to a logic level corresponding to a desired valve open or valve closed condition.

A preferred embodiment further includes a source of a pump-enable signal to operate the fuel dispenser and having an output signal applied to the controller. The controller outputs the electrical signal to open the valve when the motor is operating and the pump enable signal is activated and to close the valve when motor operation is not detected or the pump enable signal is deactivated.

In an alternate embodiment, the invention provides a vapor recovery fuel dispenser including a liquid fuel pump for pumping liquid fuel from a fuel reservoir along a fuel delivery line to an outlet, a vapor pump for returning fuel vapors from proximate the liquid fuel outlet along a vapor return line to a vapor repository, an electrically-activatable valve in the vapor return line, and a controller which monitors when the liquid fuel pump is operating and outputs an electrical signal to open the valve when the liquid fuel pump is operating and to close the valve when liquid fuel pump operation is not detected.

The controller can monitor a plurality of liquid pumps and maintains the valve open as long as one of the liquid pumps is operating. The controller may combine signals from the liquid pumps in exclusive OR gates to derive a single signal indicative of operation of any of the liquid pumps.

In a preferred embodiment the signal indicative of operation of the liquid fuel pump is a pulse train and the controller converts pulses in the pulse train to a logic level corresponding to a desired valve open or valve closed condition.

In yet a further aspect the invention provides a vapor recovery fuel dispenser including a plurality of liquid fuel pumps for pumping and blending liquid fuels from fuel reservoirs along a fuel delivery line to an outlet, a vapor pump for returning fuel vapors from proximate the outlet along a vapor return line to a vapor repository, and a controller operably interposed between the liquid fuel pumps and the vapor pump which monitors the flow rate of the liquid fuel pumps and the vapor pump and controls the speed of the vapor pump to return substantially all fuel vapors proximate the outlet with substantially no air.

The controller may combine signals from the plurality of liquid fuel pumps in exclusive OR gates to derive a single signal indicative of the combined liquid fuel flow rate through the liquid fuel pumps. In another embodiment, the controller may determine a combined flow rate by adding signals proportional to the separate flow rates. As above, the vapor pump typically includes a motor having a tachometer and the controller detects the speed of operation of the vapor pump from a signal from the tachometer. Generally, the vapor flow rate will be proportional to the motor speed, so that measuring or controlling the motor speed also measures or controls the vapor flow rate, at least to a first order approximation. The controller compares a signal indicative of the flow rate of the vapor pump and the single signal indicative of combined rate of flow through the liquid fuel pumps.

In a preferred embodiment the controller derives an error signal from the comparison and slows the vapor pump if the error signal indicates the vapor pump is pumping too fast, and accelerates the vapor pump if the error signal indicates the vapor pump is pumping too slow. The number of liquid fuel pumps may be two, three or more.

A further aspect of the invention provides a vapor recovery fuel dispenser having a liquid fuel pump for pumping liquid fuel from a fuel reservoir along a fuel delivery line to an outlet, a vapor pump for returning fuel vapors from proximate the outlet along a vapor return line to a vapor repository, and a controller operably interposed between the liquid fuel pump and the vapor pump. A first sensor generates a first pulse train representative of the flow rate of the liquid fuel pump, and a second sensor generates a second pulse train representative of the flow rate of the vapor pump. The controller controls the speed of the vapor pump to return substantially all fuel vapors proximate the outlet with substantially no air in response to evaluations of the pulse trains.

The vapor pump preferably includes a motor and the second sensor is a tachometer. In a preferred embodiment the controller converts the pulse trains to voltages. It then compares the voltages in an integrating amplifier. The controller derives an error signal from the comparison and slows the vapor pump if the error signal indicates the vapor pump is pumping too fast, and accelerates the vapor pump if the error signal indicates the vapor pump is pumping too slow. The comparison may be carried out by applying one of the voltages to the integrating amplifier as a positive term and the other as a negative term.

Also preferably included is a switch to start integration by the integrating amplifier when the pumps are started.

The invention also provides several improved vapor recovery methods. These include a method of recovering fuel vapor in a vapor recovery fuel dispenser comprising pumping liquid fuel with a liquid fuel pump from a fuel reservoir along a fuel delivery line to an outlet, pumping fuel vapors from proximate the outlet along a vapor return line to a vapor repository with a pump that is not mechanically actuated by the liquid pump, monitoring the liquid and vapor pumping to ascertain whether liquid and vapor pumping are taking place substantially simultaneously, and disabling the vapor pump when it is ascertained that vapor pumping is taking place and liquid pumping is not taking place.

Another method of recovering fuel vapor in a vapor recovery fuel dispenser includes pumping fuel vapors from proximate a liquid fuel outlet along a vapor return line to a vapor repository with a vapor pump, driving the vapor pump with a motor by providing a signal to operate the vapor pump, monitoring when the motor is operating, and disabling the vapor pump motor when motor operation is detected while not signaled to operate.

A further method of recovering fuel vapor in a vapor recovery fuel dispenser includes pumping fuel vapors from proximate a liquid fuel outlet along a vapor return line to a vapor repository with a vapor pump, driving the vapor pump with an electric motor, monitoring the electrical current to the motor, and disabling operation of the vapor pump motor when the monitored current indicates a system error.

Another method of recovering fuel vapor in a vapor recovery fuel dispenser includes pumping fuel vapors from proximate a liquid fuel outlet along a vapor return line having an electrically-activatable valve, to a vapor repository with a vapor pump, monitoring when the vapor is being pumped, and electrically signaling the valve to open when vapor is being pumped and to close when vapor is not being pumped.

A further method of recovering fuel vapor in a vapor recovery fuel dispenser includes pumping liquid fuel from a fuel reservoir along a fuel delivery line to an outlet, pumping fuel vapors from proximate the liquid fuel outlet along a vapor return line having an electrically-activatable valve, to a vapor repository, monitoring when the liquid fuel pump is operating and outputting an electrical signal to open the valve when the liquid fuel pump is operating and to close the valve when liquid fuel pump operation is not detected.

Yet another included method of recovering fuel vapor in a vapor recovery fuel dispenser has the steps of pumping and blending liquid fuels from a plurality of fuel reservoirs along a fuel delivery line to an outlet, pumping fuel vapors with a vapor pump from proximate the outlet along a vapor return line to a vapor repository, monitoring the pumping rate of the liquid fuel pumps and the vapor pump, and controlling the speed of the vapor pump to return substantially all fuel vapors proximate the outlet with substantially no air.

The invention also includes the method of recovering fuel vapor in a vapor recovery fuel dispenser which includes pumping liquid fuel from a fuel reservoir along a fuel delivery line to an outlet, pumping fuel vapors from proximate the liquid fuel outlet along a vapor return line to a vapor repository, generating a first pulse train representative of the flow rate of the liquid fuel pump, generating a second pulse train representative of the flow rate of the vapor pump, and controlling the speed of the vapor pump to return substantially all fuel vapors proximate the outlet with substantially no air in response to evaluations of the pulse trains.

BRIEF DESCRIPTION OF THE DRAWINGS

The invention will be better understood from a reading of the detailed description of the preferred embodiments along with a study of the drawings in which.

DETAILED DESCRIPTION OF THE PREFERRED EMBODIMENTS

Figure 1:
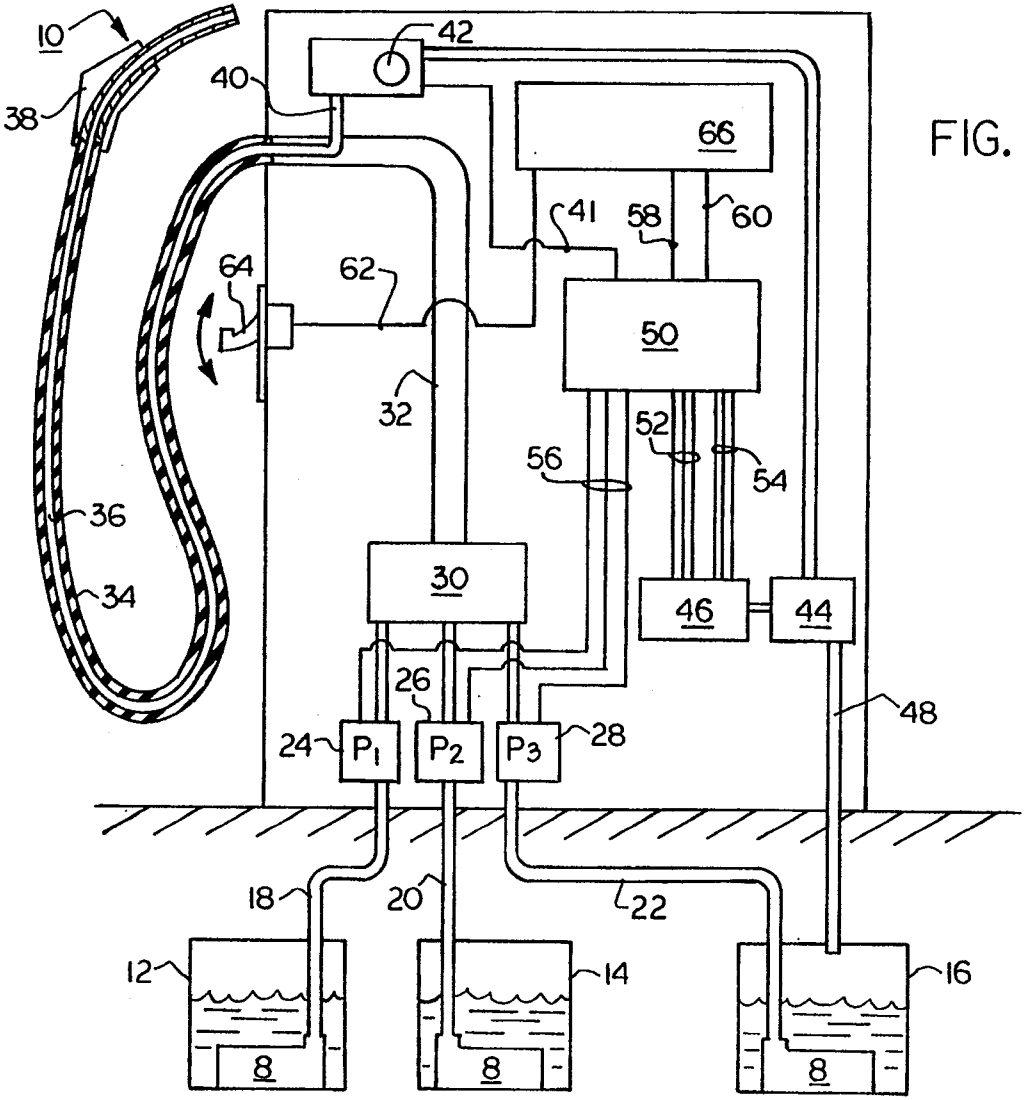
FIG. 1 is a schematic block diagram of a vapor recovery fuel dispenser in accordance with a preferred embodiment of the present invention.

A preferred embodiment of the invention is shown in schematic form in FIG. 1. The fuel dispenser 10, preferably a gasoline dispenser, is connected to a multiplicity of turbine pumps 8 in gasoline storage tanks 12, 14, 16 through pipes 18,20,22, respectively. The pipes draw gasoline from the tanks and the respective liquid flow rates are measured in meters 24,26,28. The fuel from the pipes is mixed in mixing manifold 30. The mixing manifold has downstream of it a pipe 32 which outlets to a hose 34, terminating in a controllable dispensing nozzle 38. The nozzle 38 is provided with a vapor return line which connects with a vapor return hose 36 in the hose 34, preferably concentrically within it. The vapor return line 36 connects with a vapor line 40 extending to a vapor pump 44. An electrically operated solenoid valve 42 is provided in line 40 to close off the vapor line when not in use.

Various other tank, pump and meter arrangements can also be used. In particular, the invention is useful for dispensers in which the output of each meter is passed to a separate hose, without any mixing. In such a case, the signals output on lines 56 will be exclusive; i.e. there will be a signal indicative of liquid flow only on one of the lines at a time. Dispensers of this type are sold by Glibarco, Inc. under the MPD designation.

A conventional handle 64 is mounted in the outside wall of the dispenser 10, on which the nozzle 38 can rest when not in use. As is conventional, the handle 64 is pivotally mounted, so it can be lifted after the nozzle is removed, to activate a switch, and the activation of the switch is signalled along line 62 to a transaction computer 66.

Controller 50 is provided with electrical connections 56 with the meters 24,26,28, so that signals indicative of the liquid flow rate can be transmitted from the meters to the controller 50. Preferably the meters 24,26,28 are pulsers, such as are commonly used in gasoline dispensers made by Glibarco, Inc. The pulsers emit a pulse for every 1/1000th of a gallon of gasoline passed by the pump. Thus, as the fuel is being pumped, a pulse train is delivered on the respective lines of the connections 56, with the pulse train frequencies corresponding to the liquid flow rate. The liquid pumps may, of course, be located in the dispenser 10, or elsewhere, and may have the metering devices integral with them.

Controller 50 also has a connection 41 to the valve 42 to open or close that valve, as desired. Controller 50 also has connections 58,60 to the transaction computer 66 which controls the overall operation of the dispenser 10, in conventional fashion. Line 58 transmits signals from the transaction computer 66 to the controller 50 indicating that pumping is desired, and line 60 transmits signals from the controller 50 to disable pumping, when the controller 50 has ascertained that pumping should be disabled. This will be discussed in more detail later.

The vapor pump 44 is preferably a positive displacement pump, such as the Blackmer Model VRG3/4. It is driven by a motor 46, preferably a brushless three-phase DC motor. The brushless DC motor 46 includes three hall effect sensors, one for each phase of the three-phase motor. These are used in conventional motor drive electronics in the controller 50 to apply appropriately phased power to the three phase motor 46. The hall effect signals are a form of feedback and indicate the angular displacement of the motor. Rates of change of angular displacement signalled by the hall effect sensors by a pulse frequency are sent over lines 52 to the controller 50. That is, the lines 52 provide a tachometer reading of the rate of rotation of the motor 46. The motor drive electronics portion of the controller 50 outputs three-phase power over lines 54 to the motor to drive the motor as desired. Of course, if desired, the motor can be separately driven with a separately denominated motor drive which takes its instructions from the controller 50.

The vapor of the vapor pump 44 is transmitted along line 48 back to a storage vessel. The returning vapor can be transmitted via a manifold system to the plurality of tanks 12, 14, 16 or, as shown more simply in FIG. 1, to one tank.

The controller 50 plays a number of important roles which will be described in more detail in subsequent sections. However, to generalize, the flow rate of the liquid being pumped through the lines 18, 20, 22 as controlled by the transaction computer 66, via a connection not shown, is transmitted to the controller 50 over lines 56. The controller 50 evaluates the pulse trains 56 and output signals over lines 54 to the motor 46 to drive the vapor pump 44 at a rate correlated with the liquid pumping rate. Thus, generally the faster the liquid is pumped out, the faster the vapor is retrieved.

However, the controller 50 also includes circuitry to compare whether liquid is passing the meters 24,26,28 with whether the motor 46 is being driven. In the event that the motor 46 is running, and therefore pumping vapor back to the tank 16, when liquid is not passing, the controller can disable the motor 46 to prevent the air from being pumped into the tanks 12, 14, 16. Similarly, the controller 50 can combine the flow rates of the three meters 24,26,28, whose output is mixed, to get an overall liquid flow rate to output a proper vapor pump flow rate to the motor 46. Further, the controller 50 ascertains when the liquid is passing the meters 24,26,28 (or in an alternative embodiment, when the motor 46 is being driven) and passes a signal on line 41 to open the valve 42. Further, the controller 50 includes circuitry which monitors the current drawn by the motor 46. When the current is drawn at a rate which is uncharacteristic of normal vapor pumping, it can determine an error condition, such as liquid clogging the vapor return line and disable the vapor pump. The circuitry of the controller 50 which enables these functions to be carried out will now be described:

LIQUID AND VAPOR PUMP COINCIDENCE

Figures 2, 3:
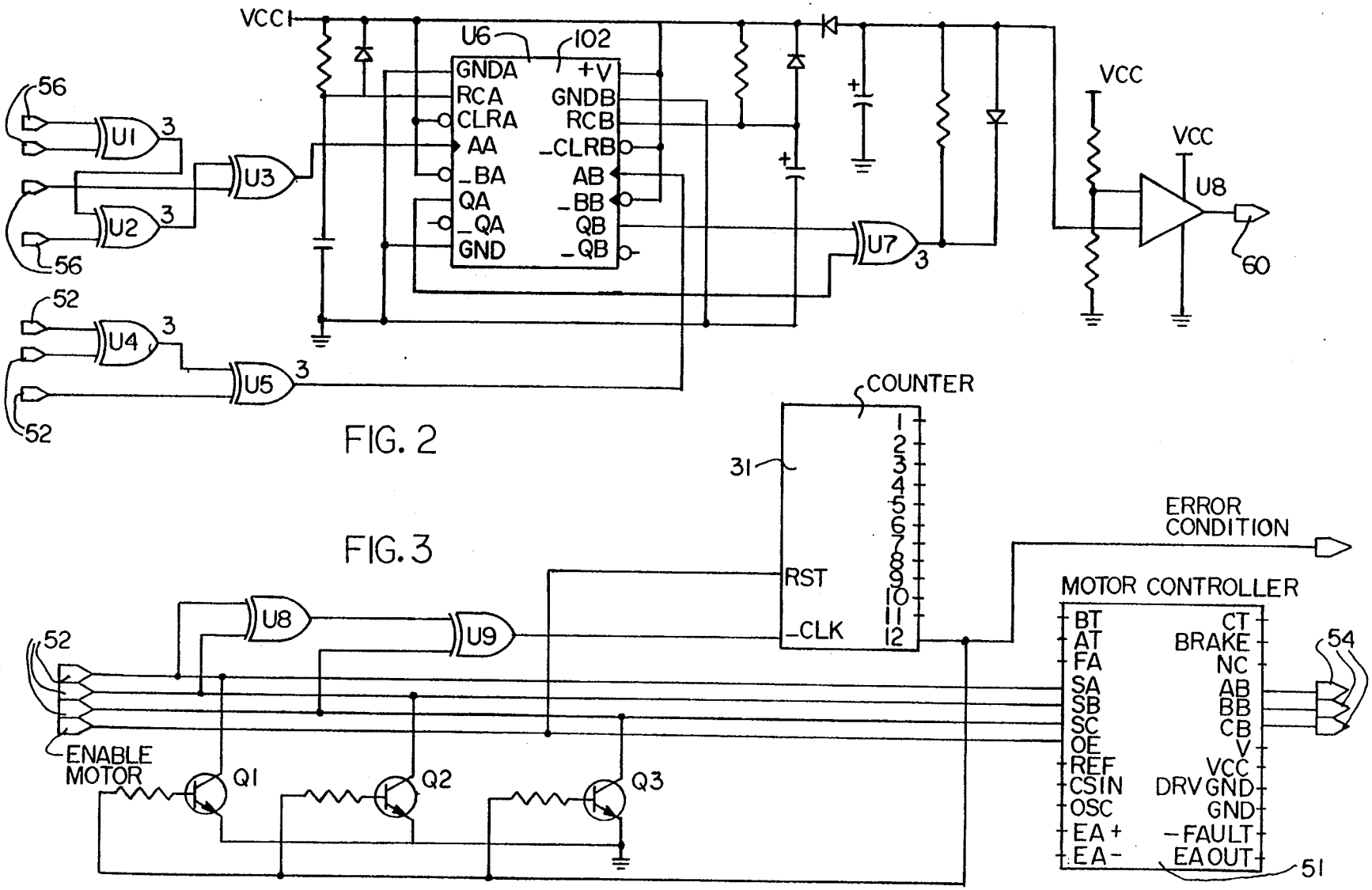
FIG. 2 is a schematic block diagram of a circuit subsystem for monitoring the status of fuel delivery and the status of vapor recovery.
FIG. 3 is a schematic block diagram of a circuit subsystem for monitoring the status of the vapor pump motor and comparing it with the signal to the motor.

Referring now to FIG. 2, there is shown a circuit useful for monitoring the status of fuel delivery and the status of the vapor recovery. If the status of these two devices, which are represented by Boolean logic levels or terms, do not agree with predetermined standards, it is deduced that an error condition exists in the vapor recovery system.

This functionality may be implemented by a variety of software or hardware embodiments. The embodiment shown in FIG. 2 includes the input of the liquid pump delivery pulse signal on lines 56, entering as a pulse train, from the meters 24,26,28, thereby indicating the presence of dispensing of fuel. A fourth signal is also shown in FIG. 2, corresponding to a possible other dispensing position or other liquid to be added to the blend. These signals are combined by exclusive OR gates U1,U2, U3, such that the dispensing of any fuel product by any source becomes noticed by transitions at the output of U3.

Likewise, the presence of vapor pump rotation is detected by combining tachometer feedback on lines 52 (or any detection of rotation) from the hall effect sensors (or other pickup device) by exclusive OR gates U4, U5 such that the rotation becomes noticed by the transitions at the output of U5. Chip U6 then converts both pulse trains (fuel delivery and motor rotation) into separate and stable logic levels by functioning as a retriggerable one-shot. The two terms are then compared by exclusive OR gate U7. If they are in disagreement for a predetermined period of time (allowing for mechanical system lags), the output of comparator U8 goes to a logic low level, thereby disabling the system. The disabling signal is the output on line 60 to the transaction computer.

This circuit will detect a vapor recovery system failure or the detection of tampering or halting of fuel dispensing, which might result in vapors escaping into the environment. It also detects a "runaway" vapor recovery system which would introduce air into the fuel storage tank if the vapor pump were operating with no fuel being dispensed. This could result in an explosive condition in the fuel storage tank if left unchecked.

SECONDARY VAPOR PUMP MONITORING

The circuit depicted in FIG. 3 monitors the status of the vapor pump motor's enabling (run or halt) signal and monitors the actual state of the motor (running or halted). If the motor is determined to be running while the system has requested a halted condition, measures are then taken to disable the motor by destroying the motor feedback to the motor drive portion of the controller. This function may be implemented by a variety of software or hardware embodiments.

In the preferred embodiment, the three-phase brushless DC motor 46 has the hall effect transducers described above. These tachometer/feedback terms proceed to the motor controller 51 to serve as rotational feedback terms for the controller 51. The presence of motor rotation is derived by monitoring and combining the motor tachometer/feedback terms by exclusive OR gates U8, U9 to produce a pulse train as the shaft of the motor rotates. The output of U9 proceeds to the clock input of counter 31, so that counter 31 is incremented for each pulse received. Likewise, the motor enable control inputs, ENABLE.MOTOR, is dually connected to the input of motor controller 51 and the reset line of counter 31. Thus, when the controller 51 is enabled, the counter 31 is held in a reset condition. Conversely, when the motor controller 51 is disabled, the counter is not held in a reset condition, and left free to increment.

Consequently, if rotational pulses are detected during a halted or disabled state, the counter 31 increments until a chosen tap (Q12 in this example) becomes true (logic high in this example), turning on transistors Q1,Q2,Q3 which ground the motor feedback signals, thereby destroying feedback to the motor controller 51 and preventing continued power to the motor. The inherent delay presented by the counter 31 allows for inertia overspin by the motor, thereby preventing false tripping caused by expected motor characteristics. An additional signal, ERROR.CONDITION, may also be derived to signal system difficulty, resulting in termination of the fuel dispenser's operation. This circuit detects a run-away vapor recovery system which would be introducing air into the fuel storage tank if the pump was operating with no fuel being dispensed, which could result in an explosive condition in the fuel storage tank if left unchecked.

LIQUID IN LINE DETECTOR

Figure 4:
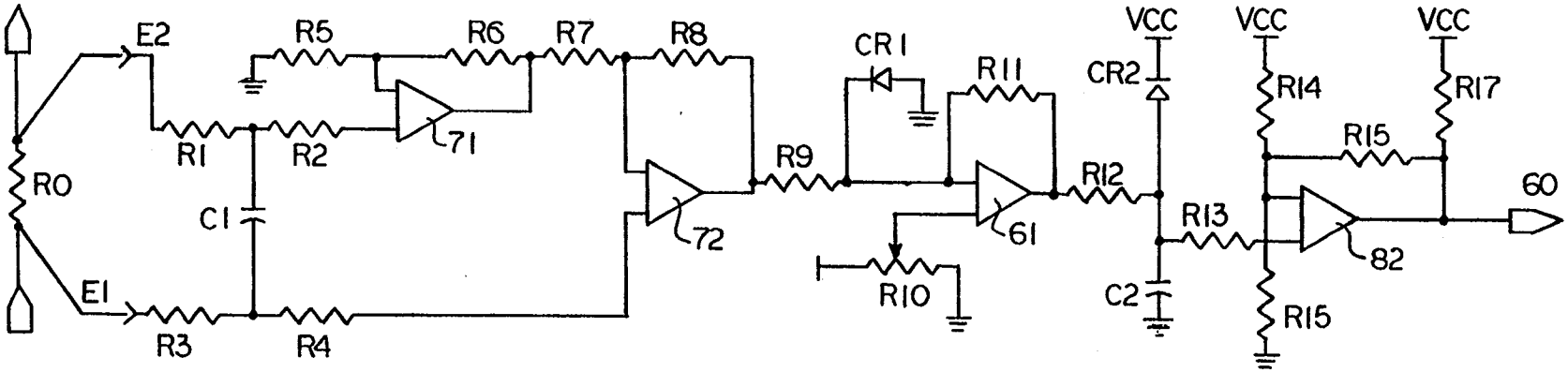
FIG. 4 is a schematic block diagram of a circuit subsystem for monitoring if liquid fuel is present in the vapor recovery system.

The circuit shown in FIG. 4 monitors to ascertain if liquid fuel is accidentally introduced into the vapor recovery system. The presence of the liquid would indicate either an attempt to "top off" a vehicle fuel tank during refueling or a poor nozzle placement, causing a splash-back condition at the vehicle's fuel tank filler neck. This condition is determined by excessive motor current as the vapor pump attempts to pump the liquid, an uncompressible medium.

While the particular function can be implemented by various embodiments, in the embodiment depicted in FIG. 4, the vapor pump motor current is measured by the voltage drop across resistor R0. This relatively small amplitude and potentially noisy (in differential- and common- mode) voltage is then filtered by R1,R3,C1 to remove high-frequency differential-mode noise and then subsequently fed into an instrumentation style differential-mode amplifier made up of amplifier 71, amplifier 72, and resistors R5, R6, R7, R8 through impedance matching resistors R2, R4. The differential-mode amplifier serves to amplify the signal to usable levels while also removing common-mode noise. The resultant voltage, available at the output of amplifier 72 is further clamped to positive-only values by resistor R9 and diode CR1. The resultant signal is then presented to comparator 61 to be compared to a set threshold, as provided by potentiometer R10. R10's threshold is set to be representative of a motor current produced when liquid is passing through the vapor pump. If the actual motor current passes this set threshold, the output of comparator 61 goes high, thereby charging capacitor C2. After a finite delay to discriminate against motor start-up transients, the voltage across C2 becomes greater than the voltage set by divider resistors R14, R15 such that comparator 82's output, FLUID. DETECT, goes high, indicating liquid present in the vapor recovery system. The FLUID.DETECT signal is passed on line 60 to the transaction computer 66 to disable operation. Additionally, a locked-rotor condition caused by ice, motor or pump failure will cause the motor current to be in excess of that caused during vapor pumping, likewise causing FLUID.DETECT to become true. Therefore, the signal FLUID.DETECT may be used to detect either condition, and ultimately to terminate the operation of the fuel dispenser.

This circuit provides three major benefits: 1) detection of splash-back which results in "purchased fuel" being returned back to the station owner and not the consumer; 2) detection of "topping off", which is illegal in California; and 3) detection of a locked-rotor condition which represents another system malfunction. Detection prevents or terminates the dispensing of fuel since no vapor collection is possible.

VAPOR LINE VALVE

Figure 5:
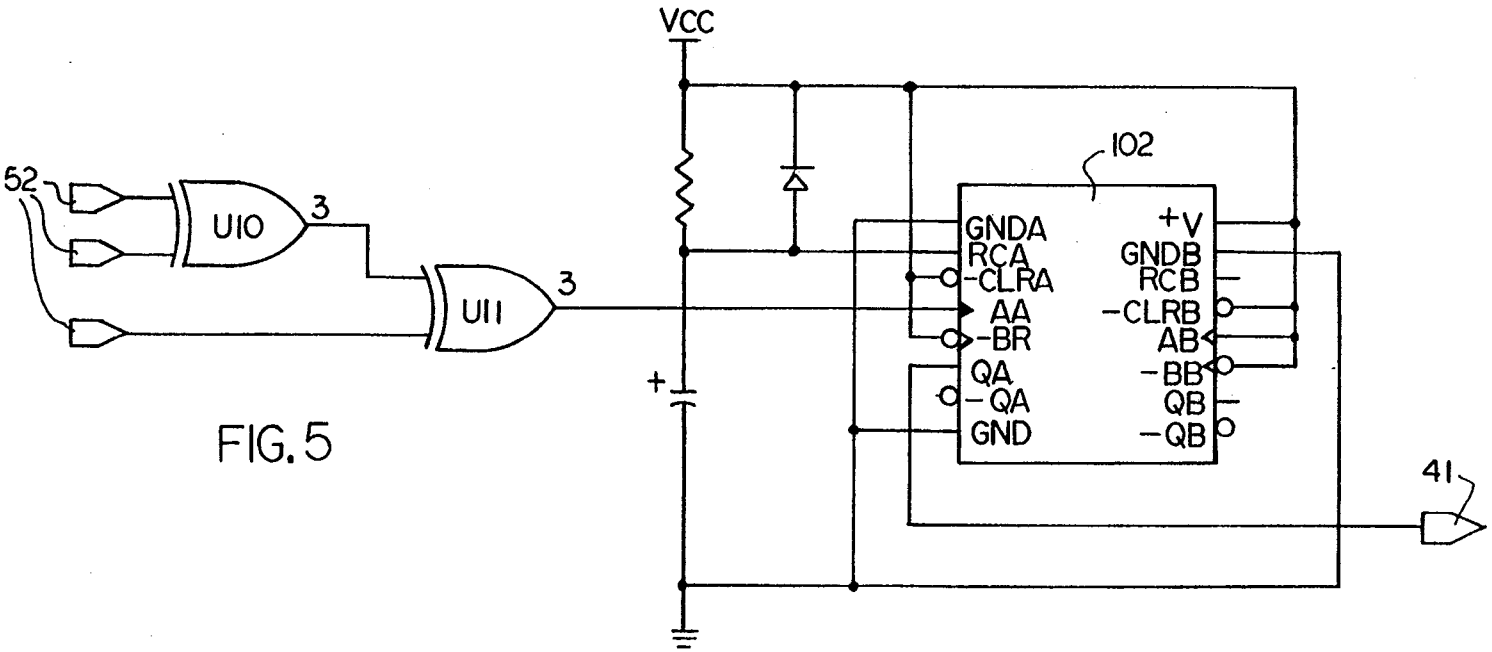
FIG. 5 is a schematic block diagram of a circuit subsystem for opening the solenoid valve.

Referring now to FIG. 5, a circuit is depicted for opening the solenoid valve 42 when vapor pumping is to be implemented. Various other hardware and software embodiments may be employed. In the FIG. 5 embodiment, vapor pump rotation is detected by combining the tachometer feedback signals 52 from the hall effect sensors of motor 46 in exclusive OR gates U10, U11. Thus, rotation becomes noticed by transitions at the output of exclusive OR gate U11. One shot 102 then converts the pulse train into a stable logic level signal by functioning as a retriggerable one shot whose period is greater than the typical minimum pulse period produced by the motor feedback signals during operation. This signal, the output of one shot 102 is then used to gate the vapor solenoid valve by outputting the signal on line 41.

It should be noted that alternately (or in conjunction) the presence or detection of liquid fuel flow (i.e., the signals on line 56) may be substituted for (or logically combined with) the presence or detection of vapor pump motor rotation. This substitution (or combination) is possible because in a working system, vapor pump motor rotation will be a function of liquid fuel flow.

During periods of motor rotation where the vapor pump is actively moving vapors from the nozzle to the vapor return lines, the signal output on line 41 is true, and the vapor solenoid valve 42 may be opened with assured direction of flow. During periods of no motor rotation, that signal becomes false, closing the valve and preventing the escape of vapors via system back pressure.

The system eliminates the escape of vapors into the atmosphere during idle dispensing periods and eliminates the need for a check valve in the vapor return line or dispensing nozzle. Also, since the valve is not located in the nozzle, which is subject to accident, breakage and abuse, the cost of replacement of the nozzle is lessened by locating the valve in the dispenser.

BLENDING LIQUID

Figure 6:
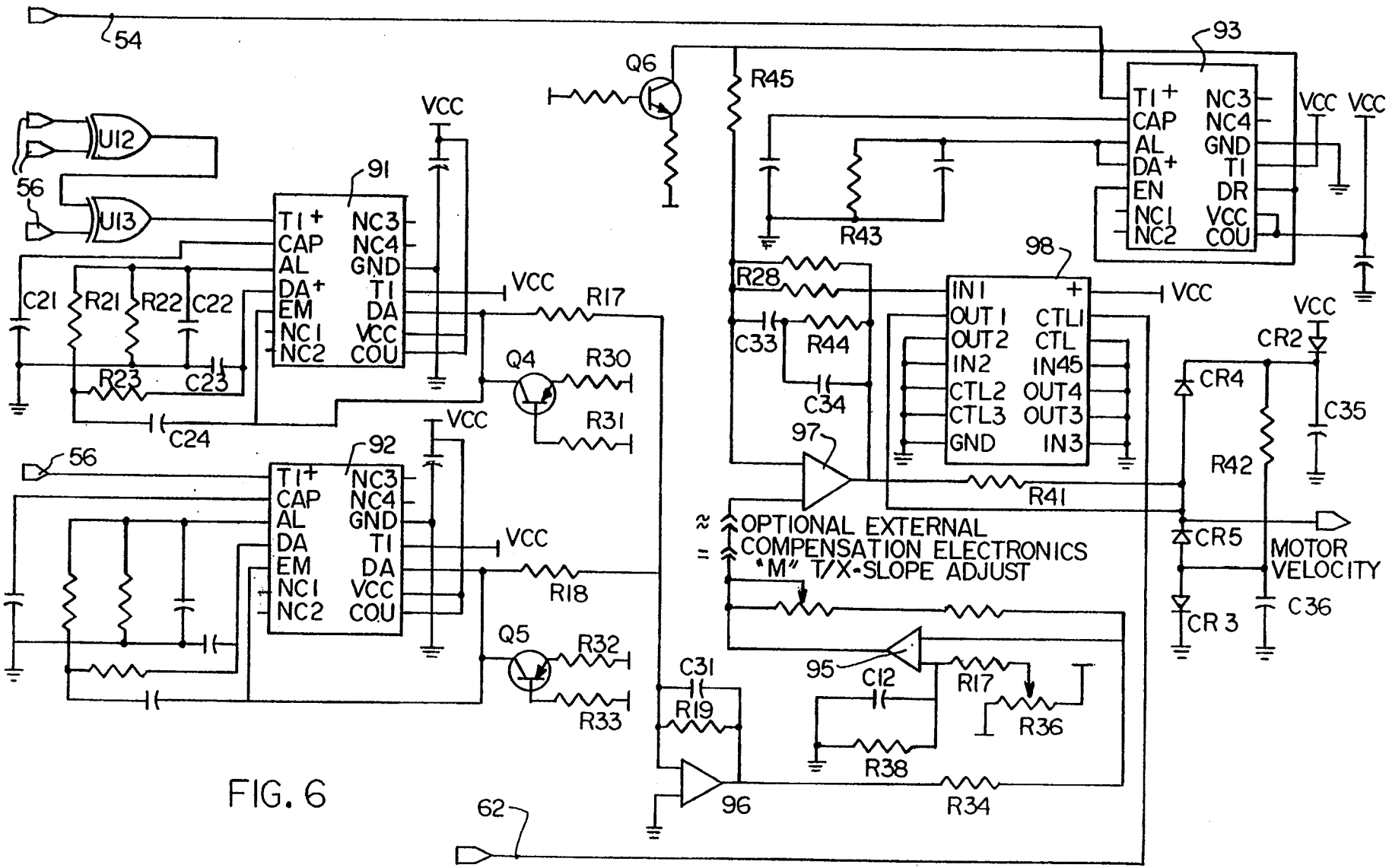
FIG. 6 is a schematic block diagram of a circuit subsystem for controlling a vapor pump when blended fuels are dispensed.

The circuit shown in FIG. 6 may be used for determining and controlling the vapor pump motor speed to correlate with the liquid flow being pumped, where multiple liquid sources are used and the liquids are blended. The invention may be implemented by a variety of software or hardware embodiments.

In this embodiment, liquid flow is derived by inputting a pulse train whose frequency is a function of liquid flow, and converting these pulses to a voltage whose amplitude is directly proportional to the pulse train's frequency. Separate, but exclusively occurring pulse trains may enter along lines 56 from the liquid pumps. If blending is desired, preconditioning to assure that the pulse trains are not in quadrature is necessary. Various circuits to achieve this will be apparent to those of ordinary skill in the art. Otherwise, the signals to U12 and U13 should come from meters which do not operate simultaneously.

These pulse trains are digitally combined by exclusive OR gates U12,U13 such that any pulse transition from any of the aforementioned inputs results in a pulse transition at the output of exclusive OR gate U13. These transitions are then inputted to FN (frequency to voltage) converter 91, such that for zero transitions (frequency=zero), a nominal potential of 0 volts is present at its output. Likewise, for a given non-zero frequency of transitions at its input, FN converter 91 outputs a voltage as a function of (e.g. linearly proportional) the input frequency, supply voltage VDD, and components C21 and R22. Components R21 ,R23,C22,C23,C24 further serve to remove artifacts from the conversion process and to tailor the response resulting from variations of input frequency.

An additional pulse train source may be inputted simultaneously or separately for a different meter at the lower level input 56'. This pulse train is similarly converted to a voltage in F/V converter 92 with identical resistors and capacitors to those used above. The output of FN converter 92 is mathematically summed with the output of F/V converter 91 via inverting amplifier 96, gain-setting resistors R17,R18,R19, compensation capacitor R31 and current drains comprising Q4,Q5,R30,R31,R32,R33,R34. The resulting output of inverting amplifier 96 represents the sum of the liquid flows from the two possible simultaneous input sources, allowing the use of fuel blending dispensers which simultaneously meter two separate grades of fuel. The use of the F/V converters permits addition of the signals, without concern of digital signals obscuring one another by being out of, or in, phase.

Note that if the signals on lines 56 are quiescent, but the signal of line 56' is not, the output of the inverting amplifier 96 will represent only that flow, allowing a fourth metering device to be interfaced to the vapor control system, thereby supporting four-product dispenser applications.

The sum flow term from the output of the inverting amplifier 96 is then fed to the input of inverting amplifier 95, where slope and offset operations are performed. These two operations provide for assignment of a first-order relationship between fuel flow and motor velocity, or specifically the equation: $V=M(m+B)$, where V is the vapor motor velocity, m is the rate of liquid fuel flow, B is a constant offset term, and M is a constant multiplier term. In this example, M is adjustable via potentiometer R36, and B is adjustable via potentiometer R38.

Also, in this embodiment, provision is made to insert additional circuitry between the output of the inverting amplifier 95 and the subsequent integration stage such that additional terms corresponding to pressure and temperature may be introduced, for example, temperature compensation as disclosed in copending application Ser. No. 824,702, filed Jan. 21, 1992 and assigned to the assignee of the present invention. That application discloses withdrawing the vapor through a bellows-free nozzle so that the vapor flow rate is determined by the vapor pumping speed. Temperature sensors generate second and third signals respectively representing the absolute temperatures of liquid in the liquid delivery path and vapor. The electronics are responsive to the second and third signals to increase the volumetric flow of the vapor recovery means when the temperature of the liquid is greater than the temperature of vapor and to decrease the volumetric flow to the vapor recovery means when the temperature of the liquid is less than the temperature of the vapor. The entire disclosure of that application is hereby incorporated by reference.

Separately, instantaneous motor velocity derived from the motor tachometer (such as taken from U11 shown in FIG. 5) is inputted to F/V converter 93 as a pulse train whose frequency is proportional to velocity. F/V converter 93 is likewise configured as F/V converters 91 and 92 with the exception of the omission of response tailoring components, as the subsequent inverting input of the integrating stage serves as an artifact and response filter. FN converter 93 then outputs a voltage whose amplitude is linearly proportional to motor velocity.

The two major terms, liquid flow and vapor pump motor velocity, are now fed into integrating amplifier 97, with flow being a positive term (driving term) and velocity being a negative term (feedback term). The difference between these two terms is then integrated over time, with the output of integrating amplifier 97 now incorporating an error term which is used to correct for perturbations and motor speed if the instantaneous speed differs from that given by the previously stated equation: $V=M(m+B)$.

Furthermore, integrating amplifier 97 provides complex (pole and zero) compensation for the motor/pump assembly, effectively compensating for inertial mass and mass induced-delays such that effective step and ramp response to changes in fuel flow is maintained at all times and under all flow rate slewing and pump loading conditions. This network is comprised of resistors R43,R44,R45 and capacitors C33,C34.

Additionally, analog switch 98 is included to assure that integration begins at time=0, initial system start-up. This prevents continuous integration and the subsequent accumulation of error should the system be disabled and unable to respond to the integrator's output. The omission of this function would either result in either an abrupt short-term burst of motor rotation at system start-up for a positive integration accumulation, or a lag in initial motor start-up for a negative integration accumulation.

Finally, since integrator 97's output is capable of slewing both positive or negative, a clamp network comprised of R41,R42,CR2,CR3,CR4,CR5,C35,C36 is provided at the integrator's output. This limits excursions to a range compatible with the motor drive electronics.

Since the vapor pumping rate is correlated with the aggregate liquid flow rate, the vapor pump can operate to return substantially all of the vapor proximate the nozzle 38 with substantially no air.

UNITARY SYSTEM

Figure 7A:
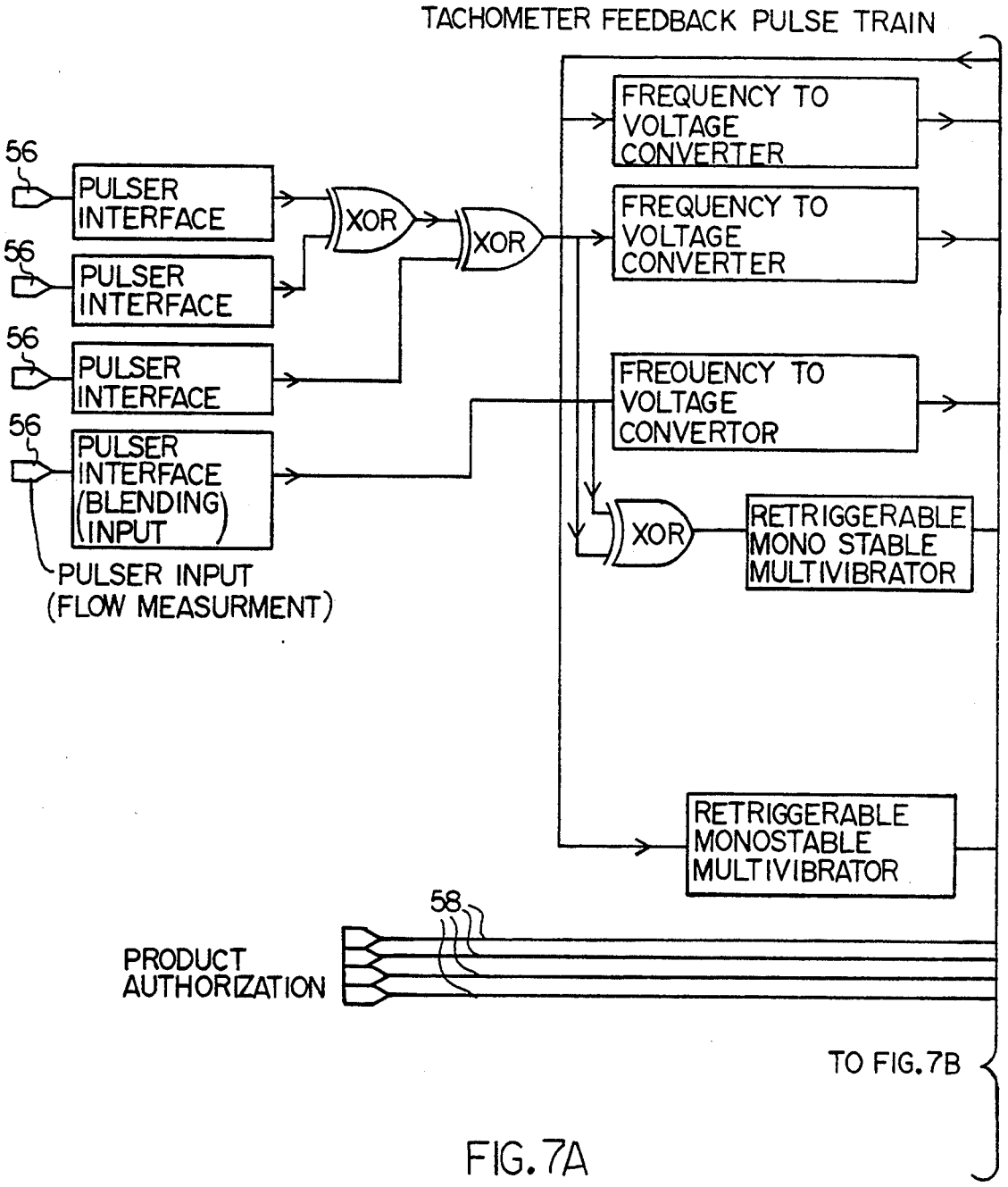
FIG. 7A and 7B are simplified block diagram of the five sub-systems depicted in FIG. 2–6 merged together.
Figure 7B:
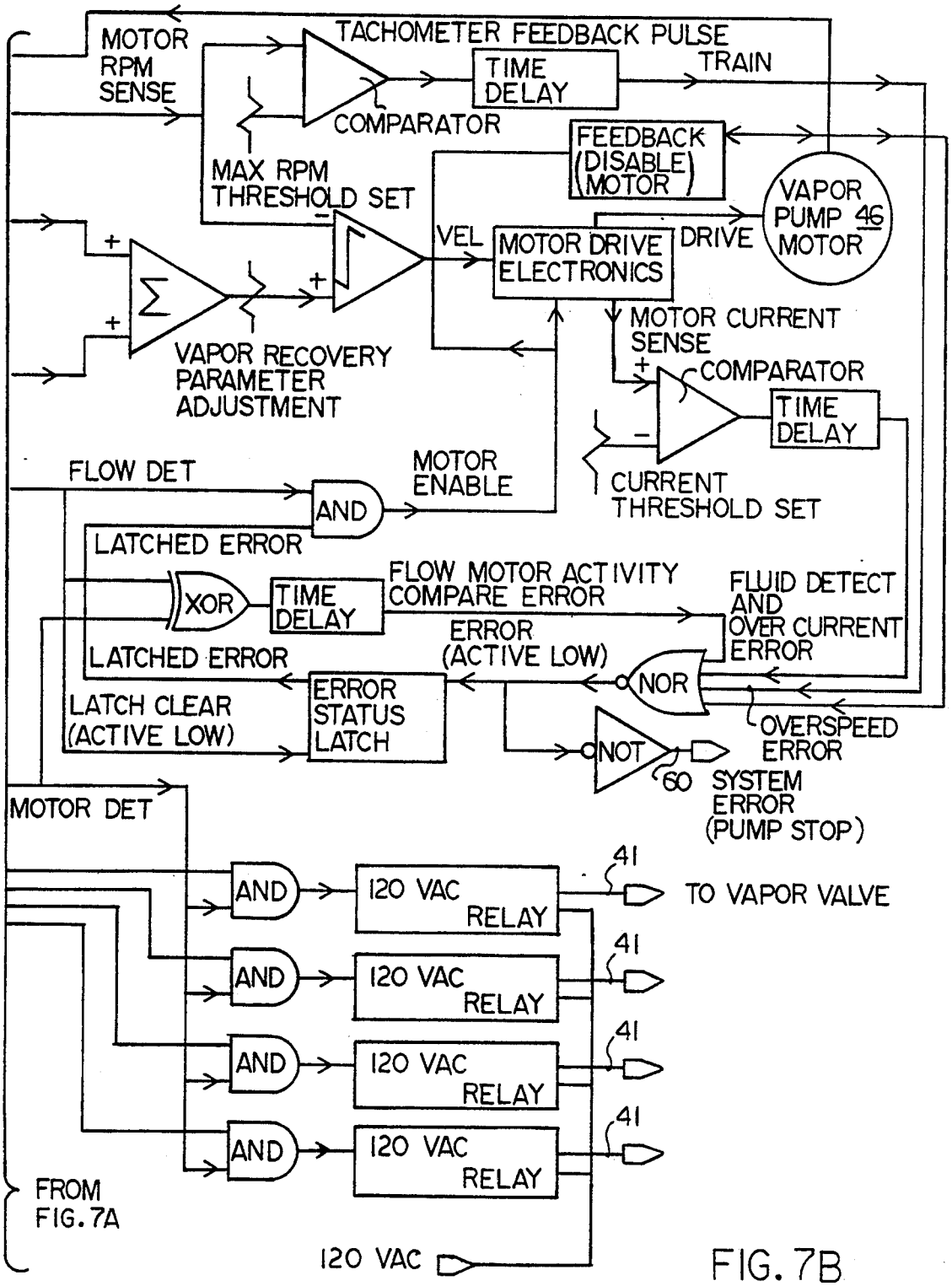

Referring now to FIG. 7, a circuit diagram in a simplified block form illustrates the various sub-systems of FIGS. 2–5 combined together. Having described each of the sub-circuits independently, it is believed that those of ordinary skill in the art will readily understand the functioning of the bulk of the circuit depicted in FIG. 7. However, the circuit shown in FIG. 7 also includes an Error Status Latch 104, which latches an error signal out to AND gate 106 to disable the motor drive electronics whenever any of the error conditions are noticed in NOR gate 108. The latch is reset by a clearing input form the signals 56 when the liquid pump is next restarted. If the error is cleared, operation may resume. If not, the error will be detected and again disable the dispenser.

While the invention has been disclosed with respect to a particularly preferred embodiment, those of ordinary skill in the art will appreciate that the functionalities obtained can be obtained through numerous other systems, electrical, mechanical and hardware. The present invention is deemed to be broad enough to encompass apparatus of such sort. Similarly, the invention includes methods of operation of the recovery liquid fuel dispenser as outlined herein. The circuitry has largely been described with reference to analog operation, but those of ordinary skill in the art will be able without undue experimentation to devise digital circuitry to accomplish the same functionalities, and these digital circuits are deemed to be within the scope of this invention.

What is claimed is:

1. A vapor recovery fuel dispenser comprising a. a plurality of liquid fuel pumps for pumping and blending liquid fuels from fuel reservoirs along a fuel delivery lines to an outlet, first sensors that generate pulse trains representative of the flow rates of said liquid fuel lines, b. a vapor pump, an electric motor driving said vapor pump for returning fuel vapors from proximate said outlet a vapor return line, and a vapor repository, said vapor pump directing vapors from said outlet along said vapor return line to said vapor repository, a second sensor that generates a second pulse train representative of the speed of said electric motor, c. said electric motor driving said vapor pump in response to a signal to operate said vapor pump, d. an electrically-activatable valve in said vapor return line, and e. a controller operably interposed between said liquid fuel delivery lines and said vapor pump, wherein said controller 1) monitors a) whether said liquid pumps are operating, b) whether said electric motor is operating, and c) the electrical current to said electric motor, 2) outputs an electrical signal to open said valve when liquid fuel is being pumped through said liquid fuel delivery line and to close said valve when vapor pump motor operation or liquid pumping is not detected, 3) controls the speed of said vapor pump to return substantially all fuel vapors proximate said outlet with substantially no excess air in response to evaluations of said pulse trains, and 4) disables operation of said electric motor when a) said liquid pumps are not operating, b) electric motor operation is detected while not signaled to operate, or c) the monitored current indicates a malfunction.

2. A vapor recovery fuel dispenser comprising a liquid fuel delivery line having a liquid fuel outlet, a vapor return line from said outlet to a vapor repository, a liquid fuel pump for pumping liquid fuel from a fuel reservoir along said fuel delivery line to said outlet, a vapor pump for returning fuel vapors from proximate said outlet along said vapor return line to said vapor repository, a motor driving said pump in response to a signal to operate said vapor pump, and a controller operably interposed between said liquid fuel delivery line and said vapor pump which monitors when both pumps are operating and when said pumps are signaled to operate and disables operation of said vapor pump motor when said liquid pump is not detected to be operating and vapor pump motor operation is detected while not signaled to operate.

3. A vapor recovery fuel dispenser comprising a liquid fuel delivery line having a liquid fuel outlet, a vapor return line from said outlet to a vapor repository, a liquid fuel pump for pumping liquid fuel from a fuel reservoir along said fuel delivery line to said outlet, a vapor pump for returning fuel vapors from proximate said outlet along said vapor return line to said vapor repository, an electric motor driving said pump, and a controller operably interposed between said liquid fuel delivery line and said vapor pump which monitors when both pumps are operating and which monitors the electrical current to said motor and which disables operation of said vapor pump motor when said liquid pump is not operating and when the monitored current indicates a system malfunction.

4. A vapor recovery fuel dispenser comprising a liquid fuel delivery line having a liquid fuel outlet, a vapor return line from said outlet to a vapor repository, a liquid fuel pump for pumping liquid fuel from a fuel reservoir along said fuel delivery line to said outlet, a vapor pump for returning fuel vapors from proximate said outlet along said vapor return line to said vapor repository, an electrically-activatable valve in said vapor return line upstream of said vapor pump, a motor driving said pump in response to a signal to operate said vapor pump, and a controller operably interposed between said liquid fuel delivery line and said vapor pump which monitors when both pumps are operating and disables operation of said vapor pump motor when said liquid pump is not operating, and monitors when said motor is operating and outputs an electrical signal to open said valve when motor operation is detected and to close said valve when motor operation is not detected.

5. A vapor recovery fuel dispenser comprising a liquid fuel delivery line having a liquid fuel outlet, a vapor return line from said outlet to a vapor repository, a liquid fuel pump for pumping liquid fuel from a fuel reservoir along said fuel delivery line to said outlet, a vapor pump for returning fuel vapors from proximate said outlet along said vapor return line to said vapor repository, an electrically-activatable valve in said vapor return line upstream of said vapor pump, and a controller operably interposed between said liquid fuel delivery line and said vapor pump which monitors when both pumps are operating and disables operation of said vapor pump when said liquid pump is not operating, and monitors when liquid fuel is being pumped through said liquid fuel delivery line and outputs an electrical signal to open said valve when said liquid fuel pumping is detected and to close said valve when liquid fuel pumping is not detected.

6. A vapor recovery fuel dispenser comprising a plurality of liquid fuel delivery lines having a single liquid fuel outlet, a vapor return line from said outlet to a vapor repository, a plurality of liquid fuel pumps for pumping and blending liquid fuels from fuel reservoirs along said fuel delivery lines to said outlet, a vapor pump for returning fuel vapors from proximate said outlet along a vapor return line to said vapor repository, and a controller operably interposed between said liquid fuel delivery lines and said vapor pump which i. monitors when both said vapor pump is operating and liquid fuel is being pumped through one of said liquid fuel delivery lines and disables operation of said vapor pump when operation of said vapor pump is detected while no liquid fuel pumping is detected, and ii. monitors the flow rates of said liquid fuel through said liquid fuel delivery lines and said vapor pump and controls the speed of said vapor pump to return substantially all fuel vapors proximate said outlet with substantially no excess air.

7. A vapor recovery fuel dispenser comprising a liquid fuel delivery line having a liquid fuel outlet, a vapor return line from said outlet to a vapor repository, a liquid fuel pump for pumping liquid fuel from said fuel reservoir along said fuel delivery line to said outlet, a first sensor that generates a first pulse train representative of the speed of liquid fuel pumping, a vapor pump for returning fuel vapors from proximate said outlet along said vapor return line to said vapor repository, a second sensor that generates a second pulse train representative of the flow rate of said vapor pump, and a controller operably interposed between said first sensor and said vapor pump which monitors when liquid is being pumped and when said vapor pump is operating and disables operation of said vapor pump when liquid is not being pumped, and controls the speed of said vapor pump to return substantially all fuel vapors proximate said outlet with substantially no excess air in response to evaluations of said first and second pulse trains.

8. A vapor recovery fuel dispenser comprising a liquid fuel delivery line having a liquid fuel outlet, a vapor return line from said outlet to a vapor repository, a vapor pump for returning fuel vapors from proximate said liquid fuel outlet along said vapor return line to said vapor repository, and electric motor driving said pump in response to a signal to operate said vapor pump, and a controller which monitors when said motor is operating and disables operation of said vapor pump motor when motor operation is detected while not signaled to operate, and monitors the electrical current to said motor and disables operation of said vapor pump motor when the monitored current indicates a system malfunction.

9. A vapor recovery fuel dispenser comprising a liquid fuel delivery line having a liquid fuel outlet, a vapor return line from said outlet to a vapor repository, a vapor pump for returning fuel vapors from proximate said liquid fuel outlet along said vapor return line to said vapor repository, an electrically-activatable valve in said vapor return line upstream of said vapor pump, a motor driving said pump in response to a signal to operate said vapor pump, and a controller which monitors when said motor is operating and outputs an electrical signal to open said valve when said motor is operating and to close said valve when motor operation is not detected and disables operation of said vapor pump motor when motor operation is detected while not signaled to operate.

10. A vapor recovery fuel dispenser comprising a liquid fuel delivery line having a liquid fuel outlet, a vapor return line from said outlet to a vapor repository, a liquid fuel pump for pumping liquid fuel from said fuel reservoir along said fuel delivery line to said outlet, a vapor pump for returning fuel vapors from proximate said liquid fuel outlet along said vapor return line to said vapor repository, a motor driving said vapor pump in response to a signal to operate said vapor pump, an electrically-activatable valve in said vapor return line upstream of said vapor pump, and a controller which monitors when said motor is operating and disables operation of said vapor pump motor when motor operation is detected while not signaled to operate, and monitors when liquid fuel is being pumped through said liquid fuel delivery line and outputs an electrical signal to open said valve when said liquid fuel is being pumped through said liquid fuel delivery line and to close said valve when liquid fuel pumping is not detected.

11. A vapor recovery fuel dispenser comprising a liquid fuel delivery line having a liquid fuel outlet, a vapor return line from said outlet to a vapor repository, a liquid fuel pump for pumping liquid fuel from said fuel reservoir along said fuel delivery line to said liquid fuel outlet, a vapor pump for returning fuel vapors from proximate said outlet along said vapor return line to said vapor repository, and a controller which monitors when said vapor pump is operating and also monitors when liquid fuel is being pumped through said liquid fuel delivery line and outputs a signal to disable operation of said vapor pump when said liquid pumping is not detected.

12. A vapor recovery fuel dispenser as claimed in claim 11 wherein said controller permits continued operation of said vapor pump for a short period after liquid pumping cessation is detected to allow for mechanical inertia.

13. A vapor recovery fuel dispenser as claimed in claim 11 wherein said controller monitors when liquid fuel is being pumped in a plurality of liquid fuel delivery lines and permits continued operation of said vapor pump as long as liquid fuel is being pumped in one of said liquid fuel delivery lines.

14. A vapor recovery fuel dispenser as claimed in claim 13 wherein said controller combines signals from said liquid fuel delivery lines in exclusive OR gates to derive a single signal indicative of pumping in any of said liquid fuel delivery lines.

15. A vapor recovery fuel dispenser as claimed in claim 11 wherein said vapor pump includes a motor having a tachometer and said controller detects operation of said vapor pump from a signal from said tachometer.

16. A vapor recovery fuel dispenser as claimed in claim 15 wherein said motor is a three phase brushless DC motor and each phase has a tachometer in the form of a hall effect sensor monitored by said controller.

17. A vapor recovery fuel dispenser as claimed in claim 16 wherein said controller combines signals from said hall effect sensors in exclusive OR gates to derive a single signal indicative of operation of said vapor pump.

18. A vapor recovery fuel dispenser as claimed in claim 17 wherein said controller combines signals from a plurality of liquid fuel delivery lines in exclusive OR gates to derive a single signal indicative of pumping in any of said liquid fuel delivery lines and compares said single signal indicative of operation of said vapor pump and said single signal indicative of pumping.

19. A vapor recovery fuel dispenser as claimed in claim 18 wherein said controller disables operation of said fuel dispenser if said two signals disagree for a period of time in excess of a threshold.

20. A vapor recovery fuel dispenser comprising a plurality of liquid fuel pumps for pumping and blending liquid fuels from fuel reservoirs along a plurality of fuel delivery lines to an outlet, a vapor pump for returning fuel vapors from proximate a liquid fuel outlet along a vapor return line to a vapor repository, a motor driving said vapor pump in response to a signal to operate said vapor pump, and a controller operably interposed between said liquid fuel delivery line and said vapor pump which monitors the flow rates of said liquid fuel delivery lines and said vapor pump and controls the speed of said vapor pump to return substantially all fuel vapors proximate said outlet with substantially no excess air and monitors when said motor is operating and disables operation of said vapor pump motor when motor operation is detected while not signaled to operate.

21. A vapor recovery fuel dispenser comprising a liquid fuel delivery line having a liquid fuel outlet, repository, a vapor pump for returning fuel vapors from proximate said liquid fuel outlet along a vapor return line to said vapor repository, a vapor pump motor driving said pump in response to a signal to operate said vapor pump, and a controller which monitors when said motor is operating and the signal to operate the pump and outputs a signal to disable operation of said vapor pump motor when motor operation is detected while not signaled to operate.

22. A vapor recovery fuel dispenser as claimed in claim 21 wherein said controller permits continued operation of said vapor pump motor for a short period after detection of cessation of said signal to operate to allow for mechanical inertia.

23. A vapor recovery fuel dispenser as claimed in claim 21 wherein said motor has a tachometer and said controller detects operation of said motor from a signal from said tachometer.

24. A vapor recovery fuel dispenser as claimed in claim 23 wherein said motor is a three phase brushless DC motor and each phase has a tachometer in the form of a hall effect sensor monitored by said controller.

25. A vapor recovery fuel dispenser as claimed in claim 24 wherein said controller combines signals from said hall effect sensors in exclusive OR gates to derive a single signal indicative of operation of said motor.

26. A vapor recovery fuel dispenser as claimed in claim 25 wherein said controller disables operation of said motor if said signal indicative of operation of said motor and said signal to operate said vapor pump disagree for a period of time in excess of a threshold.

27. A vapor recovery fuel dispenser as claimed in claim 21 wherein said signal indicative of operation of said motor is a pulse train and said controller counts pulses in said pulse train during periods when said signal to operate said vapor pump is absent and disables operation of said motor when a threshold number of pulses is counted.

28. A vapor recovery fuel dispenser comprising a liquid fuel delivery line having a liquid fuel outlet, a vapor return line from said outlet to a vapor repository, a liquid fuel pump for pumping liquid fuel from a fuel reservoir along said fuel delivery line to said outlet, a first sensor for said liquid fuel delivery line that generates a first pulse train representative of the flow rate of said liquid fuel, a vapor pump for returning fuel vapors from proximate said liquid fuel outlet along said vapor return line to said vapor repository, a second sensor that generates a second pulse train representative of the flow rate of said vapor pump, a motor driving said vapor pump in response to a signal to operate said vapor pump, and a controller operably interposed between said first sensor, said second sensor and said vapor pump for controlling the speed of said vapor pump to return substantially all fuel vapors proximate said outlet with substantially no excess air in response to evaluations of said pulse trains and monitoring when said motor is operating and outputting a signal disabling operation of said vapor pump motor when motor operation is detected while not signaled to operate.

29. A vapor recovery fuel dispenser comprising a liquid fuel delivery line having a liquid fuel outlet a vapor return line from said outlet to a vapor repository, a vapor pump for returning fuel vapors from proximate said liquid fuel outlet along said vapor return line to said vapor repository, an electrically-activatable valve in said vapor return line upstream of said vapor pump, an electric motor driving said vapor pump in response to a signal to operate said vapor pump, and a controller which monitors when said motor is operating and outputs an electrical signal to open said valve when said motor is operating and to close said valve when motor operation is not detected, and monitors the electrical current to said motor and disables operation of said vapor pump motor when the monitored current indicates a malfunction.

30. A vapor recovery fuel dispenser comprising a liquid fuel delivery line having a liquid fuel outlet, a vapor return line from said outlet to a vapor repository, a liquid fuel pump for pumping liquid fuel from a fuel reservoir along said fuel delivery line to said outlet, a vapor pump for returning fuel vapors from proximate said liquid fuel outlet along said vapor return line to said vapor repository, an electric motor driving said pump, an electrically-activatable valve in said vapor return line upstream of said vapor pump, and a controller which monitors the electrical current to said motor and disables operation of said vapor pump motor when the monitored current indicates a malfunction, and monitors when liquid fuel is being pumped through said liquid fuel delivery line and outputs an electrical signal to open said valve when liquid fuel is being pumped through said liquid fuel delivery line and to close said valve when liquid fuel pumping is not detected.

31. A vapor recovery fuel dispenser comprising a liquid fuel delivery line having a liquid fuel outlet, a vapor return line from said outlet to a vapor repository, a vapor pump for returning fuel vapors from proximate said liquid fuel outlet along said vapor return line to said vapor repository, an electric motor driving said vapor pump, and a controller which monitors the electrical current to said motor and disables operation of said vapor pump motor when the monitored current indicates a malfunction.

32. A vapor recovery fuel dispenser as claimed in claim 31 wherein said controller permits continued operation of said vapor pump motor during short periods of high current but disables operation when current exceeds a threshold level for a threshold period of time.

33. A vapor recovery fuel dispenser as claimed in claim 31 wherein said motor has windings and a resistive element in series therewith and the motor current is detected by a drop in voltage across said resistive element.

34. A vapor recovery fuel dispenser as claimed in claim 33 wherein said motor is a three phase brushless DC motor.

35. A vapor recovery fuel dispenser as claimed in claim 33 wherein said controller includes a filter to filter the voltage across said resistive element to remove noise.

36. A vapor recovery fuel dispenser as claimed in claim 35 wherein said controller disables operation of said motor if said filtered voltage exceeds a threshold voltage for a period of time in excess of a threshold period of time.

37. A vapor recovery fuel dispenser as claimed in claim 35 wherein said controller includes a potentiometer between a voltage source and a comparator, said filtered voltage is applied to said comparator and said controller disables operation of said motor if said filtered voltage exceeds a voltage set by a setting of said potentiometer for a period of time in excess of a threshold period of time.

38. A vapor recovery fuel dispenser comprising a plurality of liquid fuel delivery lines having a single liquid fuel outlet, a vapor return line from said outlet to a vapor repository, a plurality of liquid fuel pumps for pumping and blending liquid fuels from fuel reservoirs along said fuel delivery lines to said outlet, a vapor pump for returning fuel vapors from proximate said liquid fuel outlet along said vapor return line to said vapor repository, an electric motor driving said vapor pump, and a controller operably interposed between said liquid fuel delivery lines and said vapor pump which monitors the electrical current to said vapor pump motor and disables operation of said vapor pump motor when the monitored current indicates a malfunction, and monitors the flow of said liquid fuels and said vapor pump and controls the speed of said vapor pump to return substantially all fuel vapors proximate said outlet with substantially no excess air.

39. A vapor recovery fuel dispenser comprising a liquid fuel delivery line having a liquid fuel outlet, a vapor return line from said outlet to a vapor repository, a liquid fuel pump for pumping liquid fuel from a fuel reservoir along said fuel delivery line to said outlet, a first sensor that generates a first pulse train representative of the flow rate of said liquid fuel, a vapor pump for returning fuel vapors from proximate a liquid fuel outlet along said vapor return line to said vapor repository, a second sensor that generates a second pulse train representative of the flow rate of said vapor pump, an electric motor driving said vapor pump, and a controller operably interposed between said liquid fuel delivery line and said vapor pump motor, wherein said controller controls the speed of said vapor pump motor to return substantially all fuel vapors proximate said outlet with substantially no excess air in response to evaluations of said pulse trains, and monitors the electrical current to said motor and disables operation of said vapor pump motor when the monitored current indicates a malfunction.

40. A vapor recovery fuel dispenser comprising a liquid fuel delivery line having a liquid fuel outlet, a vapor return line from said outlet to a vapor repository, a liquid fuel pump for pumping liquid fuel from a fuel reservoir along said fuel delivery line to said outlet, a vapor pump for returning fuel vapors from proximate said liquid fuel outlet along said vapor return line to said vapor repository, an electrically-activatable valve in said vapor return line upstream of said vapor pump, a motor driving said vapor pump in response to a signal to operate said vapor pump, and a controller which monitors when said motor is operating and when liquid fuel is being pumped and outputs an electrical signal to open said valve when said motor is operating and liquid fuel is being pumped and to close said valve when motor operation and liquid fuel pumping is not detected.

41. A vapor recovery fuel dispenser comprising a liquid fuel delivery line having a liquid fuel outlet, a vapor return line from said outlet to a vapor repository, a vapor pump for returning fuel vapors from proximate said liquid fuel outlet along said vapor return line to said vapor repository, an electrically-activatable valve in said vapor return line upstream of said vapor pump, a motor driving said vapor pump in response to a signal to operate said vapor pump, and a controller which monitors when said motor is operating and outputs an electrical signal to open said valve when said motor is operating and to close said valve when motor operation is not detected.

42. A vapor recovery fuel dispenser as claimed in claim 41 wherein said motor has a tachometer and said controller detects operation of said motor from a signal from said tachometer.

43. A vapor recovery fuel dispenser as claimed in claim 42 wherein said motor is a three phase brushless DC motor and each phase has tachometer in the form of a hall effect sensor monitored by said controller.

44. A vapor recovery fuel dispenser as claimed in claim 43 wherein said controller combines signals from said hall effect sensors in exclusive OR gates to derive a single signal indicative of operation of said motor.

45. A vapor recovery fuel dispenser as claimed in claim 41 wherein said signal indicative of operation of said motor is a pulse train and said controller converts pulses in said pulse train to a logic level corresponding to a desired valve open or valve closed condition.

46. A vapor recovery fuel dispenser as claimed in claim 41 further comprising a source of a pump-enable signal to operate said fuel dispenser having an output signal applied to said controller and wherein said controller outputs said electrical signal to open said valve when said motor is operating and said pump enable signal is activated and to close said valve when motor operation is not detected or said pump-enable signal is deactivated.

47. A vapor recovery fuel dispenser comprising a plurality of liquid fuel delivery lines having a single liquid fuel outlet, a vapor return line from said outlet to a vapor repository, a plurality of liquid fuel pumps for pumping and blending liquid fuels from fuel reservoirs along said fuel delivery lines to said outlet, a vapor pump for returning fuel vapors from proximate said liquid fuel outlet along said vapor return line to said vapor repository, an electrically-activatable valve in said vapor return line, a motor driving said pump in response to a signal to operate said vapor pump, and a controller operably interposed between said liquid fuel delivery lines and said vapor pump which monitors the flow rate through said liquid fuel delivery lines and said vapor pump and controls the speed of said vapor pump to return substantially all fuel vapors proximate said outlet with substantially no excess air, and monitors when said motor is operating and outputs an electrical signal to open said valve when said motor is operating and to close said valve when motor operation is not detected.

48. A vapor recovery fuel dispenser comprising a liquid fuel delivery line having a liquid fuel outlet., a vapor return line from said outlet to a vapor repository, a liquid fuel pump for pumping liquid fuel from a fuel reservoir along said fuel delivery line to a liquid fuel outlet, a first sensor that generates a first pulse train representative of the flow rate of fuel through said liquid fuel delivery line, a vapor pump for returning fuel vapors from proximate said liquid fuel outlet along said vapor return line to said vapor repository, a second sensor that generates a second pulse train representative of the flow rate of said vapor pump, an electrically-activatable valve in said vapor return line upstream of said vapor pump, a motor driving said vapor pump in response to a signal to operate said vapor pump, and a controller operably interposed between said liquid fuel delivery line and said vapor pump for controlling the speed of said vapor pump to return substantially all fuel vapors proximate said outlet with substantially no excess air in response to evaluations of said pulse trains, and for monitoring when said motor is operating and outputting an electrical signal to open said valve when said motor is operating and to close said valve when motor operation is not detected.

49. A vapor recovery fuel dispenser comprising a plurality of liquid fuel delivery lines having a single liquid fuel outlet, a vapor return line from said outlet to a vapor repository, a plurality of liquid fuel pumps for pumping and blending liquid fuels from fuel reservoirs along said fuel delivery lines to said outlet, a vapor pump for returning fuel vapors from proximate said liquid fuel outlet along said vapor return line to said vapor repository, an electrically-activatable valve in said vapor return line, and a controller operably interposed between said liquid fuel delivery lines and said vapor pump which monitors the flow rate of fuel being pumped through said liquid fuel delivery lines and said vapor pump and controls the speed of said vapor pump to return substantially all fuel vapors proximate said outlet with substantially no excess air, and monitors when fuel is being pumped through said liquid fuel delivery line and outputs an electrical signal to open said valve when fuel is being pumped through at least one of said liquid fuel delivery lines and to close said valve when pumping of liquid fuel through said liquid fuel delivery line is not detected.

50. A vapor recovery fuel dispenser comprising a liquid fuel delivery line having a liquid fuel outlet, a vapor return line from said outlet to a vapor repository, a liquid fuel pump for pumping liquid fuel from a fuel reservoir along said fuel delivery line to said outlet, a first sensor that generates a first pulse train representative of the flow rate of said fuel through said liquid fuel delivery line, a vapor pump for returning fuel vapors from proximate said liquid fuel outlet along said vapor return line to said vapor repository, a second sensor that generates a second pulse train representative of the flow rate of said vapor pump, an electrically-activatable valve in said vapor return line, and a controller operably interposed between said first sensor, said second sensor and said vapor pump for controlling the speed of said vapor pump to return substantially all fuel vapors proximate said outlet with substantially no excess air in response to evaluations of said pulse trains and monitoring when said liquid fuel is being pumped through said liquid fuel delivery line and outputting an electrical signal to open said valve when said liquid fuel is being pumped through said liquid fuel delivery line and to close said valve when liquid fuel pumping is not detected.

51. A vapor recovery fuel dispenser comprising a liquid fuel delivery line having a liquid fuel outlet, a vapor return line from said outlet to a vapor repository, a liquid fuel pump for pumping liquid fuel from a fuel reservoir along said fuel delivery line to said outlet, a vapor pump for returning fuel vapors from proximate said liquid fuel outlet along said vapor return line to said vapor repository, an electrically-activatable valve in said vapor return line upstream of said vapor pump, and a controller which monitors when said liquid fuel is being pumped through said liquid fuel delivery line and outputs an electrical signal to open said valve when said liquid fuel is being pumped through said liquid fuel delivery line and to close said valve when liquid fuel is not being pumped through said liquid fuel delivery line.

52. A vapor recovery fuel dispenser as claimed in claim 51 wherein said controller monitors a plurality of liquid fuel delivery lines and maintains said valve open as long as liquid fuel is being pumped in one of said liquid fuel delivery lines.

53. A vapor recovery fuel dispenser as claimed in claim 52 wherein said controller combines signals from said liquid fuel delivery lines in exclusive OR gates to derive a single signal indicative of pumping in any of said liquid fuel delivery lines.

54. A vapor recovery fuel dispenser as claimed in claim 51 wherein said signal indicative of fuel being pumped through said liquid fuel delivery line is a pulse train and said controller converts pulses in said pulse train to a logic level corresponding to a desired valve open or valve closed condition.

55. A vapor recovery fuel dispenser as claimed in claim 51 further comprising a user-operable switch and a source of a pump-enable signal to operate said fuel dispenser having an output signal applied to said controller and wherein said controller outputs said electrical signal to open said valve when liquid fuel is being pumped through said liquid fuel delivery line and said pump-enable signal is activated and to close said valve when fuel is not being pumped through said liquid fuel delivery line or said use-operable switch is deactivated.

56. A vapor recovery fuel dispenser comprising a plurality of liquid fuel pumps for pumping and blending liquid fuels from fuel reservoirs along and a plurality of liquid fuel delivery lines connected to an outlet, a vapor return line and a vapor pump for returning fuel vapors from proximate said outlet along said vapor return line to a vapor repository, and a controller operably interposed between said liquid fuel delivery lines and said vapor pump which monitors the flow rate of fuel through said liquid fuel delivery lines and said vapor pump and controls the speed of said vapor pump to return substantially all fuel vapors proximate said outlet with substantially no excess air.

57. A vapor recovery fuel dispenser as claimed in claim 56 wherein said controller combines signals indicative of the flow rates of fuel through said plurality of liquid fuel delivery lines to derive a single signal indicative of the combined liquid fuel flow rate.

58. A vapor recovery fuel dispenser as claimed in claim 56 wherein said vapor pump includes a motor having a tachometer and said controller detects the speed of operation of said vapor pump from a signal from said tachometer.

59. A vapor recovery fuel dispenser as claimed in claim 56 wherein said controller combines signals indicative of the flow rates of said plurality of liquid fuel delivery lines to derive a single signal indicative of a combined rate of flow through said liquid fuel delivery lines and compares a signal indicative of the speed of operation of said vapor pump and said single signal indicative of the combined rate of flow of liquid.

60. A vapor recovery fuel dispenser as claimed in claim 59 wherein said controller derives an error signal from said comparison and slows said vapor pump if the error signal indicates said vapor pump is pumping too fast, and accelerates said vapor pump if the error signal indicates said vapor pump is pumping too slow.

61. A vapor recovery fuel dispenser as claimed in claim 56 wherein said plurality of liquid fuel delivery lines is at least three.

62. A vapor recovery fuel dispenser comprising
a liquid fuel delivery line having a liquid fuel outlet,
a vapor return line from said outlet to a vapor repository,
a liquid fuel pump for pumping liquid fuel from a fuel reservoir along said fuel delivery line to said outlet,
a first sensor that generates a first pulse train representative of the flow rate of said fuel through said liquid fuel delivery line,
a vapor pump for returning fuel vapors from proximate said outlet along said vapor return line to said vapor repository,
a second sensor that generates a second pulse train representative of the flow rate of said vapor pump, and
a controller operably interposed between said first sensor and second sensors and said vapor pump for controlling the speed of said vapor pump to return substantially all fuel vapors proximate said outlet with substantially no excess air in response to evaluations of said pulse trains.

63. A vapor recovery fuel dispenser as claimed in claim 62 wherein said vapor pump includes a motor and said second sensor is a tachometer.

64. A vapor recovery fuel dispenser as claimed in claim 62 wherein said controller converts said pulse trains to voltages.

65. A vapor recovery fuel dispenser as claimed in claim 64 wherein said controller compares said voltages in an integrating amplifier.

66. A vapor recovery fuel dispenser as claimed in claim 65 wherein said controller derives an error signal from said comparison and slows said motor if the error signal indicates said vapor pump is pumping too fast, and accelerates said motor if the error signal indicates said vapor pump is pumping too slow.

67. A vapor recovery fuel dispenser as claimed in claim 65 wherein one of said voltages is applied to said integrating amplifier as a positive term and the other is applied as a negative term.

68. A vapor recovery fuel dispenser as claimed in claim 65 further comprising a switch to start integration by said integrating amplifier when said pumps are started.

69. A method of recovering fuel vapor in a vapor recovery fuel dispenser comprising
pumping liquid fuel with a liquid fuel pump from a fuel reservoir along a fuel delivery line to an outlet,
pumping fuel vapors from proximate the outlet along a vapor return line to a vapor repository with a pump that is not mechanically actuated by the liquid pump,
monitoring the liquid and vapor pumping to ascertain whether liquid and vapor pumping are taking place substantially simultaneously, and
disabling operation of the vapor pump when it is ascertained that vapor pumping is taking place and liquid pumping is not taking place.

70. A method of recovering fuel vapor in a vapor recovery fuel dispenser comprising
pumping fuel vapors from proximate a liquid fuel outlet along a vapor return line to a vapor repository with a vapor pump,
driving the vapor pump with a motor by providing a signal to operate the vapor pump motor,
monitoring the signal to the motor to operate the vapor pump, and
monitoring when the motor is operating, and disabling operation of the vapor pump motor when motor operation is detected while not signaled to operate.

71. A method of recovering fuel vapor in a vapor recovery fuel dispenser comprising
pumping fuel vapors from proximate a liquid fuel outlet along a vapor return line to a vapor repository with a vapor pump,
driving the vapor pump with an electric motor,
monitoring the electrical current to the motor, and
disabling operation of the vapor pump motor when the monitored current indicates a malfunction.

72. A method of recovering fuel vapor in a vapor recovery fuel dispenser comprising
pumping fuel vapors from proximate a liquid fuel outlet along a vapor return line having an electrically-activatable valve, to a vapor repository with a vapor pump,
monitoring when vapor is being pumped, and
electrically signaling the valve to open when the vapor is being pumped, thereby opening a path for vapor to reach the vapor pump and to close when vapor is not being pumped.

73. A method of recovering fuel vapor in a vapor recovery fuel dispenser comprising
pumping liquid fuel from a fuel reservoir along a fuel delivery line to an outlet,
pumping fuel vapors from proximate the liquid fuel outlet along a vapor return line having an electrically-activatable valve to a vapor repository,
monitoring when the liquid fuel is being pumped through the fuel delivery line and
outputting an electrical signal to open the valve when the liquid fuel is being pumped through the liquid fuel delivery line and to close the valve when liquid fuel pumping is not detected.

74. A method of recovering fuel vapor in a vapor recovery fuel dispenser comprising
pumping and blending liquid fuels from a plurality of fuel reservoirs along a plurality of fuel delivery lines to an outlet,
pumping fuel vapors with a vapor pump from proximate the outlet along a vapor return line to a vapor repository,
monitoring the pumping rate of the liquid fuel in the liquid fuel lines and the vapor pump, and
controlling the speed of the vapor pump to return substantially all fuel vapors proximate the outlet with substantially no excess air.

75. A method of recovering fuel vapor in a vapor recovery fuel dispenser comprising
pumping liquid fuel from a fuel reservoir along a fuel delivery line to an outlet,
pumping fuel vapors from proximate the liquid fuel outlet along a vapor return line to a vapor repository,
generating a first pulse train representative of the flow rate of the liquid fuel,
generating a second pulse train representative of the flow rate of the vapor pump, and
controlling the speed of the vapor pump to return substantially all fuel vapors proximate the outlet with substantially no excess air in response to evaluations of the pulse trains.

76. A vapor recovery fuel dispenser comprising
a liquid fuel delivery line having a liquid fuel outlet a vapor return line from said outlet to a vapor repository, a liquid fuel pump for pumping liquid fuel from a fuel reservoir along said fuel delivery line to said outlet, a vapor pump for returning fuel vapors from proximate said outlet along said vapor return line to said vapor repository, temperature sensors to sense the temperature of liquid fuel being pumped and of vapor being returned, a valve in said vapor return line upstream of said vapor pump, and a controller operably interposed between said liquid fuel delivery line and said vapor pump which monitors the flow rate of said liquid fuel and said vapor pump and the temperatures of the liquid fuel being pumped and the vapor being returned and controls the speed of said vapor pump to return substantially all fuel vapor proximate said outlet to said repository with substantially no excess air.

* * * * *

UNITED STATES PATENT AND TRADEMARK OFFICE

CERTIFICATE OF CORRECTION

PATENT NO. : 5,355,915
DATED : October 18, 1994
INVENTOR(S) : Payne, Hartsell and Pope It is certified that error appears in the above—identified patent and that said Letters Patent is hereby corrected as shown below:

On the cover page, item [75]: Inventors should, include:

Kenneth L. Pope, Walkertown, North Carolina
Hal C. Hartsell, Jr., Kernersville, North Carolina In the Claims:

In claim 21, column 18, line 19, delete the word "repository"

Signed and Sealed this

Twenty-fifth Day of February, 1997

*Attest:*

Bruce Lehman

BRUCE LEHMAN

*Attesting Officer*

*Commissioner of Patents and Trademarks*

US005355915C1

(12) EX PARTE REEXAMINATION CERTIFICATE (6941st)

United States Patent

Payne et al.

(10) Number: US 5,355,915 C1

(45) Certificate Issued: Jul. 21, 2009

(54) VAPOR RECOVERY IMPROVEMENTS

(75) Inventors: Edward A. Payne, Greensboro, NC (US); Kenneth L. Pope, Walkertown, NC (US); Hal C. Hartsell, Jr., Kernersville, NC (US)

(73) Assignee: Gilbarco Inc., Greensboro, NC (US)

Reexamination Request:
No. 90/008,495, Mar. 22, 2007

Reexamination Certificate for:

| | |
|---|---|
| Patent No.: | **5,355,915** |
| Issued: | **Oct. 18, 1994** |
| Appl. No.: | **07/946,741** |
| Filed: | **Sep. 16, 1992** |

Certificate of Correction issued Feb. 25, 1997.

Related U.S. Application Data

(63) Continuation-in-part of application No. 07/824,702, filed on Jan. 21, 1992, now Pat. No. 5,156,199, which is a continuation of application No. 07/625,892, filed on Dec. 11, 1990, now abandoned.

(51) Int. Cl.
*B65B 3/18* (2006.01)

(52) U.S. Cl. ..... 141/83; 141/59; 141/198; 141/44

(58) Field of Classification Search ..... None
See application file for complete search history.

(56) References Cited

U.S. PATENT DOCUMENTS

| | | | |
|---|---|---|---|
| 2,047,580 | A | 7/1936 | Dewey |
| 2,401,124 | A | 5/1946 | Hawk et al. |
| 2,849,036 | A | 8/1958 | Davenport, Jr. |
| 3,016,928 | A | 1/1962 | Jay |
| 3,176,730 | A | 4/1965 | Knight |
| 3,605,824 | A | 9/1971 | Madden et al. |
| 3,695,289 | A | 10/1972 | Weissmann et al. |
| 3,756,291 | A | 9/1973 | McGahey et al. |
| 3,791,427 | A | 2/1974 | Wetmiller et al. |
| 3,815,327 | A | 6/1974 | Viland |
| 3,826,291 | A | 7/1974 | Steffens |

(Continued)

FOREIGN PATENT DOCUMENTS

DE 28 17 980 A1 11/1978

(Continued)

OTHER PUBLICATIONS

Motorola, Inc., *Linear/Interface Ics: Device Data,* vol. 1 (Motorola Literature Distribution, 1993).

(Continued)

*Primary Examiner*—Glenn K. Dawson

(57) ABSTRACT

A vapor recovery fuel dispenser includes a liquid fuel pump for pumping and blending liquid fuels from fuel reservoirs along a fuel delivery line to an outlet. A vapor pump returns fuel vapors from proximate the outlet along a vapor return line to a repository. An electric motor drives the pump in response to a signal. An electrically-activatable valve is provided in the vapor return line. A first sensor generates a first pulse train representative of the flow rate of the liquid fuel pump and a second sensor generates a second pulse train representative of the flow rate of the vapor pump.

A controller is operably interposed between the liquid fuel pumps and the vapor pump. The controller monitors whether the liquid pumps are operating, whether the vapor pump motor is operating, and the electrical current to the vapor pump motor. It also outputs an electrical signal to open the valve when the motor or liquid fuel pump is operating and to close the valve when motor operation or liquid pumping is not detected. Further, it contols the speed of the vapor pump to return substantially all fuel vapors proximate the outlet with substantially no air in response to evaluations of the pulse trains. The controller also disables operation of the vapor pump when the liquid pumps are not operating, vapor pump motor operation is detected while not signaled to operate, or the monitored current indicates a system error.

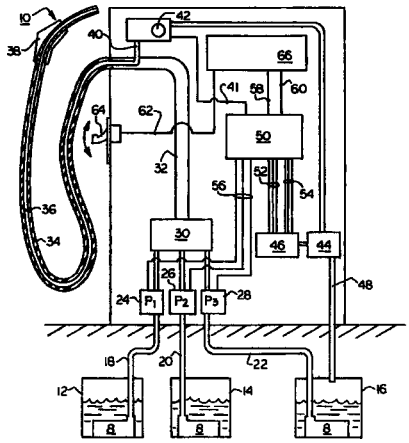

U.S. PATENT DOCUMENTS

| | | | | |
|---|---|---|---|---|
| 3,850,208 | A | | 11/1974 | Hamilton |
| 3,881,894 | A | | 5/1975 | Onufer et al. |
| 3,899,009 | A | | 8/1975 | Taylor et al. |
| 3,900,056 | A | | 8/1975 | Giardini et al. |
| 3,905,405 | A | | 9/1975 | Fowler et al. |
| 3,913,633 | A | | 10/1975 | Hiller et al. |
| 3,915,206 | A | | 10/1975 | Fowler et al. |
| 3,921,412 | A | | 11/1975 | Heath et al. |
| 3,926,230 | A | | 12/1975 | Stary et al. |
| 3,929,175 | A | | 12/1975 | Coone et al. |
| 3,941,168 | A | | 3/1976 | Hiller et al. |
| 3,946,773 | A | | 3/1976 | Hansel |
| 3,952,781 | A | | 4/1976 | Hiller et al. |
| 3,974,865 | A | | 8/1976 | Fenton et al. |
| 3,981,334 | A | | 9/1976 | Deters |
| 3,996,977 | A | | 12/1976 | Hansel |
| 3,996,979 | A | | 12/1976 | Barr et al. |
| 3,999,936 | A | | 12/1976 | Hasselmann |
| 4,009,985 | A | | 3/1977 | Hirt |
| 4,010,781 | A | | 3/1977 | Sutcliffe |
| 4,020,861 | A | | 5/1977 | Shihabi |
| 4,047,548 | A | | 9/1977 | Wagner |
| 4,056,131 | A | | 11/1977 | Healy |
| 4,057,085 | A | | 11/1977 | Shihabi |
| 4,057,086 | A | | 11/1977 | Healy |
| 4,058,147 | A | | 11/1977 | Stary et al. |
| 4,060,110 | A | | 11/1977 | Bower |
| 4,062,384 | A | | 12/1977 | Frahm et al. |
| 4,063,874 | A | | 12/1977 | Stary et al. |
| 4,068,687 | A | | 1/1978 | Long |
| 4,072,934 | A | | 2/1978 | Hiller et al. |
| 4,082,122 | A | | 4/1978 | McGahey |
| 4,083,473 | A | | 4/1978 | Goodwin et al. |
| 4,089,445 | A | | 5/1978 | Tatsuno |
| 4,095,626 | A | | 6/1978 | Healy |
| 4,100,758 | A | | 7/1978 | Mayer |
| 4,108,223 | A | | 8/1978 | Hansel |
| 4,118,170 | A | | 10/1978 | Hirt |
| 4,122,524 | A | | 10/1978 | McCrory et al. |
| 4,153,073 | A | | 5/1979 | Deters |
| 4,166,485 | A | | 9/1979 | Wokas |
| 4,167,958 | A | | 9/1979 | Voelz |
| 4,197,883 | A | | 4/1980 | Mayer |
| 4,199,012 | A | | 4/1980 | Lasater |
| 4,202,385 | A | | 5/1980 | Voelz et al. |
| 4,214,614 | A | | 7/1980 | Pyle |
| 4,223,706 | A | | 9/1980 | McGahey |
| 4,253,503 | A | | 3/1981 | Gunn |
| 4,256,151 | A | | 3/1981 | Gunn |
| 4,260,000 | A | | 4/1981 | McGahey et al. |
| 4,273,164 | A | | 6/1981 | Gunn |
| 4,292,020 | A | | 9/1981 | Hirt |
| 4,295,504 | A | | 10/1981 | Hasselmann |
| 4,295,505 | A | | 10/1981 | Hasselmann et al. |
| 4,306,594 | A | | 12/1981 | Planck |
| 4,310,033 | A | | 1/1982 | Deters |
| 4,336,830 | A | | 6/1982 | Healy |
| 4,429,725 | A | | 2/1984 | Walker et al. |
| 4,505,308 | A | | 3/1985 | Walker et al. |
| 4,522,237 | A | | 6/1985 | Endo et al. |
| 4,566,504 | A | | 1/1986 | Furrow et al. |
| 4,649,970 | A | | 3/1987 | Bower et al. |
| 4,662,539 | A | | 5/1987 | Komukai |
| 4,674,546 | A | | 6/1987 | Fournier et al. |
| 4,680,004 | A | | 7/1987 | Hirt |
| 4,687,033 | A | | 8/1987 | Furrow et al. |
| 4,720,800 | A | | 1/1988 | Suzuki et al. |
| 4,749,009 | A | | 6/1988 | Faeth |
| 4,887,578 | A | | 12/1989 | Woodcock et al. |
| 4,986,445 | A | | 1/1991 | Young et al. |
| 5,029,622 | A | | 7/1991 | Mutter |
| 5,038,838 | A | | 8/1991 | Bergamini et al. |
| 5,040,577 | A | | 8/1991 | Pope |
| 5,091,686 | A | * | 2/1992 | Baik ..... 318/798 |
| 5,123,817 | A | | 6/1992 | Willemsen |
| 5,129,432 | A | | 7/1992 | Dugger |
| 5,129,433 | A | | 7/1992 | Faeth |
| 5,141,037 | A | | 8/1992 | Carmack et al. |
| 5,156,199 | A | | 10/1992 | Hartsell et al. |
| 5,172,738 | A | | 12/1992 | Komukai et al. |
| 5,174,346 | A | | 12/1992 | Healy |
| 5,178,197 | A | | 1/1993 | Healy |
| 5,186,221 | A | | 2/1993 | Ellis |
| 5,195,564 | A | * | 3/1993 | Spalding ..... 141/1 |
| 5,197,523 | A | | 3/1993 | Fink et al. |
| 5,199,471 | A | | 4/1993 | Hartman et al. |
| 5,207,249 | A | | 5/1993 | Healy |
| 5,213,142 | A | | 5/1993 | Koch et al. |
| 5,234,036 | A | | 8/1993 | Butkovich et al. |
| 5,257,720 | A | | 11/1993 | Wulc et al. |
| 5,273,087 | A | | 12/1993 | Koch et al. |
| 5,280,814 | A | | 1/1994 | Stroh |
| 5,299,605 | A | | 4/1994 | Bergamini et al. |
| 5,301,721 | A | | 4/1994 | Hartmann |
| 5,316,057 | A | | 5/1994 | Hasselmann |
| 5,323,817 | A | | 6/1994 | Spalding |
| 5,325,896 | A | | 7/1994 | Koch et al. |
| 5,327,944 | A | | 7/1994 | Healy |
| 5,327,949 | A | | 7/1994 | Dotson et al. |
| 5,332,008 | A | | 7/1994 | Todd et al. |
| 5,332,011 | A | | 7/1994 | Spalding |
| 5,333,655 | A | | 8/1994 | Bergamini et al. |
| 5,345,979 | A | | 9/1994 | Tucker et al. |
| 5,365,985 | A | | 11/1994 | Todd et al. |
| 5,386,859 | A | | 2/1995 | Healy |
| RE35,238 | E | | 5/1996 | Pope |
| 6,899,149 | B1 | | 5/2005 | Hartsell, Jr. et al. |

FOREIGN PATENT DOCUMENTS

| | | | | |
|---|---|---|---|---|
| DE | 87 17 378.6 | U1 | | 10/1988 |
| DE | 39 03 603 | A1 | | 8/1990 |
| EP | 0 514 993 | A1 | | 11/1992 |
| EP | 0 343 884 | B1 | | 12/1992 |
| GB | 2008873 | A | * | 6/1979 |
| GB | 2 014 544 | A | | 8/1979 |
| GB | 2 053 512 | A | | 2/1981 |
| GB | 2 206 561 | A | | 1/1989 |
| GB | 2 226 812 | A | | 7/1990 |
| WO | WO 93/19004 | | | 9/1993 |

OTHER PUBLICATIONS

Ernesto Paris, *Design of an Intelligent Pump for Recovering Petrol Vapours in Petrol Stations,* University of Bari thesis paper (academic year 1987–1988).

American Lewa, Inc., *Proportional Metering,* edition 5, 1980.

Claes Albertson et al., *Report PUK Project–87 Basic Product, Gas Return,* May 19, 1987 (Original in Swedish, translation behind tab "A").

Wayne Chavez, *Brushless DC Motor Drive Incorporates Small Outline Integrated Circuit Packaged MOSFETS,* document AN1321/D, revision 1, pp. 1–7 (Motorola Literature Distribution, 1993).

Ken Berringer, *Power MOSFET, 1HP Brushless DC Motor Drive Withstands Commutation Stresses,* document AR341 (Motorola Literature Distribution, 1990).

Daniel Artusi and Warren Schultz, *Solid–State Devices Ease Task of Designing Brushless DC Motors,* document AR301, pp. 1–9 (Motorola Literature Distribution, 1987).
Kim Gauen and Jade Alberkrack, *Three Piece Solution for Brushless Motor Controller Design,* document AN1046, revision 2, pp. 1–10 (Motorola Literature Distribution, 1992).
Ken Berringer, *One–Horsepower Off–Line Brushless Permanent Magnet Motor Drive,* document AN1101, pp. 455–464 (Motorola Literature Distribution, 1990).
Warren Schultz, *Understanding SENSEFETs,* document AN1001 (Motorola Literature Distribution, 1988).
Motorola, Inc., *Linear and Interface Integrated Circuits,* document MC33034, pp. 4–56–4–75 (1990).
Declaration of Hal C. Hartsell, Jr., Aug. 17, 1994, Reissue of Pat. No. 5,040,577.
Affidavit of Hal C. Hartsell, Jr., Mar. 29, 1995, *Gilbarco, Inc.* v. *Tokheim Corp.,* Civ. Action No. WMN95–511.
Declaration of Hal C. Hartsell, Jr., Nov. 18, 1996, *Gilbarco Inc.* v. *Tokheim Corp.,* Civ. Action No. 2:95CV00581.
Declaration of Edward A. Payne with associated exhibits, Nov. 18, 1996, *Gilbarco Inc.* v. *Tokheim Corp.,* Civ. Action No. 2:95CV00581.
Affidavit of Edward A. Payne, Apr. 5, 1995, *Gilbarco, Inc.* v. *Tokheim Corp.,* Civ. Action No. WMN95–511.
Statutory Declaration of Timothy Lockhart Holland with associated exhibits, Jul. 21, 1997, *Gilbarco Inc.* v. *Tokheim Corp.,* Civ. Action No. 2:95CV00581.
Statutory Declaration of Stuart P. Fitchett, Jul. 23, 1997, *Gilbarco Inc.* v. *Tokheim Corp.,* Civ. Action No. 2:95CV00581.
Statutory Declaration of Terence Charles Rogers, Jul. 22, 1997, *Gilbarco Inc.* v. *Tokheim Corp.,* Civ. Action No. 2:95CV00581.
Statutory Declaration of Ronald Nicholson with associated exhibits, Jul. 22, 1997, *Gilbarco Inc.* v. *Tokheim Corp.,* Civ. Action No. 2:95CV00581.
Statutory Declaration of Michael Lawrence Jennings with associated exhibits, Jul. 22, 1997, *Gilbarco Inc.* v. *Tokheim Corp.,* Civ. Action No. 2:95CV00581.
Supplementary Declaration of Hal C. Hartsell, Jr. with associated exhibits, Dec. 6, 1994, Reissue of Patent No. 5,040, 577 (Exhibit 2099 to *Spalding* v. *Hartsell* Interference No. 104,699).
Declaration of Carlo Cucchi with associated exhibits, Jul. 23, 1999, (Exhibit 2014 to *Spalding* v. *Hartsell* Interference No. 104,699).
Declaration of Giorgio Bergamini with associated exhibits, Sep. 24, 2001, (Exhibit 2022 to *Spalding* v. *Hartsell* Interference No. 104,699).
Hartsell Opposition 2, Nov. 13, 2001 (*Spalding* v. *Hartsell* Interference No. 104,699).
Spalding Reply 2, Feb. 11, 2002 (*Spalding* v. *Hartsell* Interference No. 104,699).
Decision on Spalding's Preliminary Motion 2, Feb. 13, 2002 (*Spalding* v. *Hartsell* Interference No. 104,699).
"Gulf/Hasselmann Stage II Vapor Recovery System for Gasoline Dispensing Facilities" (undated).
State of California Air Resources Board Executive Order G–70–7 Relating to the Certification of the Gulf/Hasselmann VCP–2 Service Station, Phase II Vapor Recovery System, with associated exhibits, executed Jul. 2, 1977.
Statement Regarding Hasselmann Information, unpublished, 2008.
Giorgio Bergamini, Analysis of Hydrocarbon Evaporative Emission Recovery in Relation to Stage 11—On Board Alternatives, Feb. 28, 1989.
Dr. Harald Falckenberg, Stage II Vapour Recovery Systems in USA and Europe, Jun. 12, 1990.
Declaration of Hal C. Hartsell, Jr., Exhibit 1020 to *Spalding* v. *Hartsell* Interference No. 104,699, Nov. 9, 2001.
Declaration of Stuart P. Fitchett with associated exhibits, Jr., Exhibit 1023 to *Spalding* v. *Hartsell* Interference No. 104, 699, Nov. 1, 2001.
Declaration of Ronald Nicholson, Exhibit 1024 to *Spalding* v. *Hartsell* Interference No. 104,699, Nov. 2, 2001.
Declaration of Stuart P. Fitchett, Exhibit 1025 to *Spalding* v. *Hartsell* Interference No. 104,699, Nov. 8, 2001.
Declaration of Terence Charles Rogers, Exhibit 1026 to *Spalding* v. *Hartsell* Interference No. 104,699, Nov. 2, 2001.
Affidavit of Giorgio Bergamini, Exhibit 2013 to *Spalding* v. *Hartsell* Interference No. 104,699, Feb. 1, 1996.
Declaration of Kenneth W. Taylor with associated exhibit, Exhibit 2016 to *Spalding* v. *Hartsell* Interference No. 104, 699, Sep. 6, 2001.
Affidavit of Prancesco Cavalltno with associated exhibit, Exhibit 2023 to *Spalding* v. *Hartsell* Interference No. 104, 699, Sep. 26, 2001.
Declaration of Kenneth W. Taylor, Exhibit 2027 to *Spalding* v. *Hartsell* Interference No. 104,699, Sep. 27, 2001.
Declaration of John E. Hyatt Exhibit 2028 to *Spalding* v. *Hartsell* Interference No. 104,699, Sep. 27, 2001.
Declaration of Kenneth W. Taylor, Exhibit 2021 to *Spalding* v. *Hartsell* Interference No. 104,699, Sep. 6, 2001.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 31 and 71 is confirmed.

New claims 77–97 are added and determined to be patentable.

Claims 1–30, 32–70 and 72–76 were not reexamined.

*77. The vapor recovery fuel dispenser of claim 31, wherein said malfunction comprises presence of liquid fuel passing through the vapor pump indicated by the monitored current.*

*78. A vapor recovery fuel dispenser as claimed in claim 31, comprising*

*a valve disposed in the vapor return line so that the valve controls flow of the fuel vapors in the vapor return line,*

*wherein the valve is in communication with the liquid fuel delivery line so that operation of the valve is controlled responsively to flow of liquid fuel in the liquid fuel delivery line.*

*79. A vapor recovery fuel dispenser as claimed in claim 78, wherein the vapor pump is disposed in the vapor return line between the valve and the vapor repository.*

*80. A vapor recovery fuel dispenser as claimed in claim 78, wherein the valve is electrically-activatable.*

*81. A vapor recovery fuel dispenser as claimed in claim 80, wherein the controller is configured to monitor flow of the liquid fuel through the liquid fuel delivery line and to open the valve in response to flow of the liquid fuel.*

*82. A vapor recovery fuel dispenser as claimed in claim 31, wherein the controller is configured to compare the monitored current to a threshold value representative of a current produced when liquid is passing through the vapor pump.*

*83. A vapor recovery fuel dispenser as claimed in claim 31, wherein the vapor return line returns the fuel vapors responsively to flow of liquid fuel in the liquid fuel delivery line.*

*84. A vapor recovery fuel dispenser as claimed in claim 83, further comprising a valve disposed in the vapor return line, wherein the valve is in communiction with the liquid fuel delivery line so that operation of the valve is controlled responsively to flow of the liquid fuel in the liquid fuel delivery line.*

*85. A vapor recovery fuel dispenser as claimed in claim 31, comprising a controller that controls a variable speed of the electric motor to thereby vary a speed of the vapor pump.*

*86. The method of recovering fuel vapor of claim 71, wherein said malfunction comprises presence of liquid fuel passing through the vapor pump detected by said monitoring.*

*87. A method of recovering fuel vapor in a vapor recovery fuel dispenser as claimed in claim 71, comprising operating a valve disposed in the vapor return line so that the valve controls flow of the fuel vapors in the vapor return line, in response to flow of liquid fuel.*

*88. A method of recovering fuel vapor in a vapor recovery fuel dispenser as claimed in claim 71, wherein the disabling step includes comparing the monitored current to a threshold value representative of a current produced when liquid is passing through the vapor pump.*

*89. A method of recovering fuel vapor in a vapor recovery fuel dispenser as claimed in claim 71, wherein the pumping step comprises pumping the fuel vapors along the vapor return line responsively to flow of liquid fuel in a liquid fuel delivery line in the vapor recovery fuel dispenser.*

*90. A method of recovering fuel vapor in a vapor recovery fuel dispenser as claimed in claim 89, comprising operating a valve, wherein the valve is disposed in the vapor return line so that the valve controls flow of the fuel vapors in the vapor return line, in response to flow of the liquid fuel.*

*91. A method of recovering fuel vapor in a vapor recovery fuel dispenser as claimed in claim 71, wherein the driving step comprises driving a variable speed of the vapor pump by varying a speed of the electric motor.*

*92. A vapor recovery fuel dispenser comprising:*

*a plurality of liquid fuel delivery lines having respective liquid fuel outlets;*

*a plurality of liquid fuel pumps that pump liquid fuel from fuel reservoirs to the liquid fuel outlets via the liquid fuel delivery lines;*

*a vapor return line from the liquid fuel outlets to a vapor repository;*

*a vapor pump that returns fuel vapors from proximate the liquid fuel outlets along the vapor return line to the vapor repository;*

*an electric motor driving the vapor pump;*

*a controller that controls a variable speed of the electric motor in response to use of the dispenser; and*

*a controller which monitors electrical current to the vapor pump motor and disables operation of the vapor pump motor when the monitored current indicates a malfunction.*

*93. A vapor recovery fuel dispenser as claimed in claim 92, wherein the controller that monitors electrical current to the vapor pump motor monitors for an over-current condition.*

*94. A vapor recovery fuel dispenser as claimed in claim 92, wherein the controller that monitors electrical current to the motor compares the monitored current to a threshold value representative of a current produced when liquid is passing through the vapor pump.*

*95. A vapor recovery fuel dispenser comprising:*

*a liquid fuel delivery line having a liquid fuel outlet;*

*a vapor return line from the outlet to a vapor repository, wherein a valve is disposed in the vapor return line so that the valve controls flow of fuel vapors in the vapor return line, and wherein the valve is in communication with the liquid fuel delivery line so that operation of the valve is controlled responsively to flow of liquid fuel in the liquid fuel delivery line;*

*a vapor pump for returning the fuel vapors from proximate the liquid fuel outlet along the vapor return line to the vapor repository;*

*a variable speed electric motor driving the vapor pump;*

*a controller that controls a variable speed of the electric motor to thereby vary a speed of the vapor pump; and*

*a controller which monitors the electrical current to the motor and disables operation of the vapor pump motor*

*when the monitored current indicates a malfunction, wherein the malfunction comprises presence of liquid fuel passing through the vapor pump.*

*96. A method of recovering fuel vapor in a vapor recovery fuel dispenser comprising:*

*pumping fuel vapors from proximate a liquid fuel outlet along a vapor return line to a vapor repository with a vapor pump responsively to flow of liquid fuel in a liquid fuel delivery line;*

*driving the vapor pump with an electric motor at a variable speed by varying a speed of the electric motor;*

*monitoring the electrical current to the motor; and*

*disabling operation of the vapor pump motor when the monitored current indicates a malfunction.*

*97. A method of recovering fuel vapor in a vapor recovery fuel dispenser as claimed in claim 96, wherein the malfunction comprises presence of liquid fuel passing through the vapor pump.*

* * * * *